US007070860B2

(12) United States Patent
Kobayashi et al.

(10) Patent No.: US 7,070,860 B2
(45) **Date of Patent: *Jul. 4, 2006**

(54) LAMINATED FILM FOR ELECTROPHOTOGRAPHY AND METHOD FOR PRODUCING SAME, AND IMAGE FORMING METHOD

(75) Inventors: Tomoo Kobayashi, Minamiashigara (JP); Kunio Sakurai, Ashigarakami-gun (JP); Kaoru Torikoshi, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 188 days.

This patent is subject to a terminal disclaimer.

(21) Appl. No.: 10/624,689

(22) Filed: Jul. 23, 2003

(65) Prior Publication Data

US 2004/0126690 A1 Jul. 1, 2004

(30) Foreign Application Priority Data

Dec. 12, 2002 (JP) ..... 2002-360432

(51) Int. Cl.
*G03G 13/00* (2006.01)

(52) U.S. Cl. ..... 428/412; 428/480; 428/483; 430/124; 430/97; 430/48; 430/56; 369/272.1; 369/273

(58) Field of Classification Search ..... 430/124, 430/97, 48, 56; 369/272.1, 273; 428/412, 428/480, 483

See application file for complete search history.

(56) References Cited

U.S. PATENT DOCUMENTS

| | | | | |
|---|---|---|---|---|
| 4,868,632 | A | 9/1989 | Hayashi et al. | |
| 5,378,576 | A | 1/1995 | Sakai et al. | |
| 5,731,116 | A * | 3/1998 | Matsuo et al. | 430/56 |
| 6,524,760 | B1 * | 2/2003 | Ikeuchi et al. | 430/41 |
| 6,656,649 | B1 * | 12/2003 | Ohishi et al. | 430/56 |
| 2001/0044031 | A1 | 11/2001 | Ikeuchi et al. | |
| 2002/0182520 | A1 * | 12/2002 | Torikoshi | 430/18 |
| 2004/0161690 | A1 | 8/2004 | Kobayashi et al. | |

FOREIGN PATENT DOCUMENTS

| | | |
|---|---|---|
| EP | 0 104 074 A2 | 3/1984 |
| EP | 0 474 278 A1 | 3/1992 |
| EP | 0 969 330 A1 | 1/2000 |
| EP | 1 022 618 A1 | 7/2000 |
| GB | 1 423 403 | 2/1976 |
| JP | A 58-102245 | 6/1983 |
| JP | A 5-98050 | 4/1993 |
| JP | A 7-89209 | 4/1995 |
| JP | A 7-266723 | 10/1995 |
| JP | A 10-86562 | 4/1998 |

(Continued)

*Primary Examiner*—Mark A. Chapman
(74) *Attorney, Agent, or Firm*—Oliff & Berridge, PLC

(57) ABSTRACT

The invention provides an electrophotographic laminated film and a method for producing the electrophotographic laminated film. The electrophotographic laminated film comprises a substrate and at least one of a coating layer and a function control means provided on a surface of the substrate. The uppermost layer of the coating layer has a surface resistance in a range of $1.0\times10^{8}$ to $1.0\times10^{13}$ Ω/□. The surface of the substrate preferably comprises at least one of a polycarbonate resin and a polyallylate resin. At least one of the coating layer and the function control means is preferably formed by providing a coating liquid. Further, a solvent contained in the coating liquid is preferably permits at least one of the coating layer and function control means to be formed while dissolving the surface of the substrate.

16 Claims, 1 Drawing Sheet

FOREIGN PATENT DOCUMENTS

JP 11-334265 A 12/1999

JP 2001-92255 A 4/2001

* cited by examiner

LAMINATED FILM FOR ELECTROPHOTOGRAPHY AND METHOD FOR PRODUCING SAME, AND IMAGE FORMING METHOD

CROSS REFERENCE TO RELATED APPLICATIONS

This application claims benefit of and priority to Japanese Patent Application No. 2002-360432, filed on Dec. 12, 2002, which is incorporated herein by reference in its entirety for all purposes.

BACKGROUND OF THE INVENTION

1. Field of the Invention

The present invention relates to a laminated film for electrophotography on which images are directly formed (recorded) by an electrophotographic image forming device. In particular, the invention relates to a laminated film for electrophotography that can be used by; noncontact or direct-contact information media storing personal information and image information such as cash cards with full-face pictures, identification cards for a company's staff, student identification cards, membership cards, address cards, various driving license cards and various certificates; image sheets and image display panels for personal verification used in hospitals; and labels.

2. Description of the Related Art

Measures for forming a large quantity of images having an identical quality by various printing methods, such as intaglio printing, relief printing, planographic printing, photogravure printing and screen printing are known in the art, accompanying development of image forming technologies. Such printing methods have been frequently used for surface printing of information media such as IC cards, magnetic cards, optical cards or combinations of these information media, in which the media carry predetermined information and are able to communicate with external devices by a contact or non-contact mode.

However, for example, the above-mentioned screen printing method requires, a plurality of printing plates, the number of which corresponds to a number of images to be printed, and in the case of color printing, additional printing plates, the number of which corresponds to the number of colors used therein, are further required. Therefore, such printing methods are not suitable for printing respective identification information for individuals (such as full-face pictures, names, addresses, dates of birth and various certificates).

Currently, the most common image forming methods that account for the above problems are methods using printers which employ sublimation or melting thermal transfer methods using ink-ribbons. However, although these methods enable easy printing of personal identification information, these methods still have a problem in that resolution decreases when printing speed is increased, and printing speed decreases when resolution is improved.

In contrast to the above, in an electrophotographic image forming (printing) method, a surface of a image supporting member is uniformly electrified, exposed with light in accordance with image signals, an electrostatic latent image is formed in accordance with a difference in potential between exposed portions and non-exposed portions, and then a visible image (toner image) is formed on the surface of the image supporting member by electrostatic development using colored powders called toners (image forming materials) having the same (or opposite) polarity as the polarity of the electrified surface. When color images are to be formed, visible color images are formed by repeating the above steps multiple times, or by aligning a plurality of image forming devices, and these images are transferred to and fixed on (fixing: melting of the colored powders mainly by heating, and solidifying the melted colored powders by cooling) an image recording medium.

Since the electrostatic latent images are electrically formed on the surface of the image supporting member by image signals in the electrophotography method, not only can one image be formed any number of times, but image forming, which can easily correspond to different images, is possible. The toner images on the surface of the image supporting member can be almost completely transferred onto the surface of the image recording medium, and trace amounts of toner images remaining on the surface of the image supporting member can be readily removed with a resin blade and brush. Consequently, it is possible to easily produce prints corresponding to many items in small scale production.

The toner is generally formed by melt-mixing a thermal-fusible resin and pigment, and in some cases additives such as an antistatic agent, and pulverizing the kneaded product into fine particles. Resolution of the electrostatic latent image in the electrophotographic method is rather high as compared with that of the finely pulverized toner, and sufficiently high resolution can be expected as compared with resolution obtained by screen printing methods or ink ribbon thermal transfer printing methods.

By using color toners corresponding to four primary colors of cyan, megenta, yellow and black and by mixing these toners, it is theoretically possible to reproduce the same kind of colors in a same extent as in printing. Moreover, since toner resins can be relatively freely blended with pigments for forming the color toners, image concealability with the toner can be readily increased.

Heat I resistance and light stability of the image recording member in outdoor uses have been seldom studied. Particularly, the thermal-transferred images using dyes as coloring materials fade in cases when, for example, a driving license card is exposed to direct sunlight in a car. However, pigments which are excellent in light stability and exhibit various colors of cyan, magenta, yellow and black, are used in the color toners as outputs of the color images by the electrophotographic method. Accordingly, light stability of the image recording member in the electrophotographic method is considered to be sufficiently excellent. Likewise, heat resistance of the image recording member is considered to be sufficient for use outdoors if heat resistant toners are selected.

Substrates (cores) of various cards that are currently most frequently used are vinyl chloride sheets because the material is excellent in both printing characteristics and compatibility with embossing (concave and convex processing for letters). However, when being disposed of due to expiration of limitation period and the like, the vinyl chloride sheet has a problem of generating dioxins when disposed of by incineration with incinerators and the like. Thus, various sheet films are beginning to be used now as substitutes for the vinyl chloride from the view point of compatibility with the environment.

A conventionally-used biaxially-drawn PET (polyethylene terephthalate) film may be used on the premise that no embossing will be applied thereto. However, since embossing is often indispensable in order to keep the conventional function of the card, ABS resin films and polyolefin resin films that are softened at a relatively low temperature, a denatured PET resin called PETG, and integrated films of the denatured PET resin with a PET film, amorphous PET film or polycarbonate resin film are currently used.

Examples of various cards, which have been printed using the electrophotographic device are as follows.

For example, in addition to various kinds of personal information, an invisible bar-code is printed on a vinyl chloride sheet having a thickness of 250 μm or a polyester sheet having a thickness of 260 μm by electrophotography, and an over-film is disposed on a printed surface and is laminated with a heat press machine (see Japanese Patent Application Laid-Open (JP-A) No. 2001-92255).

However, because a friction coefficient between the sheets is overly large, the transfer property of the sheet becomes poor and the sheets adhere to each other. Consequently, the electrophotographic device may be interrupted. Moreover, when insulators (sheets) have a thickness of 250 μm or more as described above, image defects may increase due to the insufficient transfer of the image forming material (toner). Moreover, resin films having a relatively low softening point become sticky during the fixing process when such film is printed using the electrophotographic device, since the fixing temperature is higher than the softening temperature of the resin film, causing a trouble of generating winding jams in the fixing apparatus. Furthermore, the fixing apparatus may be unnecessarily damaged by the edge of the sheet when the image forming material is offset on the fixing device or when fixing of the sheet with a thickness of 250 μm is continued.

Alternatively, personal identification information is printed on a light permeable sheet, and the image may be printed in a mirror image (see JP-A No. 11-334265). However, JP-A No. 11-334265 merely teaches that a polyvinyl chloride sheet may be used, although at least a part of the light permeable sheet preferably comprises a biaxially drawn polyester film, or the light permeable sheet is preferably a biaxially drawn polyester film comprising ABS or polyester film.

Accordingly, a resolution comparable to that of the thermal transfer method cannot be obtained due to poor transfer of image forming materials onto the surface of the film, since the film simply made of an insulation material in JP-A No. 11-334265. Furthermore, in the printing machine emphasizing improvements of productivity, much loss and waste inevitably arise in order to comply with urgent production or small scale production of many kinds of articles when different printing works for one or several persons are required, because the laminated sheet used is in a roll form.

SUMMARY OF THE INVENTION

The present invention solves the conventional technical problems.

The invention provides an electrophotographic laminated film and a method for producing the same, and an image forming method, wherein the film can be readily laminated so that conventional electrophotographic device is directly used without large extent of reconstruction, images can be directly printed with high resolution on the surface of the film that is softened at a relatively low temperature, and a high quality image having sufficient light stability even in outdoor uses can be formed with good visual recognizability.

The inventors of the invention have found, through intensive studies, that the object above can be attained by controlling the surface resistance of the coating layer formed on the surface of the substrate, by selecting the material of the surface of the substrate, and by adjusting the load deflection temperature of the substrate at a predetermined temperature. The inventors also investigated a method for forming a mirror image, so that the image can be recognized as a normal image when the image is observed by naked eyes through the substrate from the opposed face to the face on which the image had been formed.

Various surface processing on the card is made possible by forming a function control layer on the surface opposed to the image forming surface with interposition of the substrate. Furthermore, transfer ability of the film can be improved by reducing the friction coefficient between the films as a result of using a polyester resin as the resin for coating the surface of the film and adding a filler in the polyester layer. Adding a ultraviolet ray absorber and an antioxidant permits light stability to be improved. A non-chlorine resin film is used as the substrate considering environmental protection, and a printing method comprising an image fixing method compatible with the use of the non-chlorine resin film has been taken into consideration.

A first aspect of the invention is to provide an electrophotographic laminated film comprising at least one coating layer disposed on a surface of a substrate, wherein a surface resistance of an uppermost layer of the coating layer is in a range of $1.0\times10^{8}$ to $1.0\times10^{13}$ Ω/□, and the surface of the substrate comprises at least one of a polycarbonate resin and a polyallylate resin.

A second aspect of the invention is to provide an electrophotographic laminated film comprising at least one coating layer disposed on a surface of a substrate, wherein a surface resistance of an uppermost layer of the coating layer is in a range of $1.0\times10^{8}$ to **1.0×10*hu* 13** Ω/□, and the substrate has a load deflection temperature of at least 115° C.

A third aspect of the invention is to provide a method for producing an electrophotographic laminated film, comprising the step of forming at least one of the coating layer and the function control means is formed by providing a coating liquid; wherein the electrophotographic laminated film comprises a substrate and at least one of the coating layer and the function control means provided on a surface of the substrate, the uppermost layer of the coating layer has a surface resistance in a range of $1.0\times10^{8}$ to $1.0\times10^{13}$ Ω/□, the surface of the substrate comprises at least one of a polycarbonate resin and a polyallylate resin, and a solvent contained in the coating liquid permits at least one of the coating layer and function control means to be formed while dissolving the surface of the substrate.

A fourth aspect of the invention is to provide a method for forming an image on an electrophotographic laminated film, comprising the step of forming a toner image on a surface of the electrophotographic laminated film as a mirror image; wherein the electrophotographic laminated film comprises a substrate and a coating layer provided on the surface of the substrate, the uppermost layer of the coating layer has a surface resistance in a range of $1.0\times10^{8}$ to $1.0\times10^{13}$ Ω/□, and the substrate has a load deflection temperature of at least 115° C.

A fifth aspect of the invention is to provide a method for forming an image on an electrophotographic laminated film, comprising the step of forming a toner image on a surface of the electrophotographic laminated film as a mirror image; wherein the electrophotographic laminated film comprises a substrate and a coating layer provided on the surface of the substrate, the uppermost layer of the coating layer has a surface resistance in a range of $1.0\times10^{8}$ to $1.0\times10^{13}$ Ω/□, and the substrate comprises at least one of a polycarbonate resin and a polyallylate resin in the surface thereof.

DETAILED DESCRIPTION OF THE INVENTION

Figure 1:
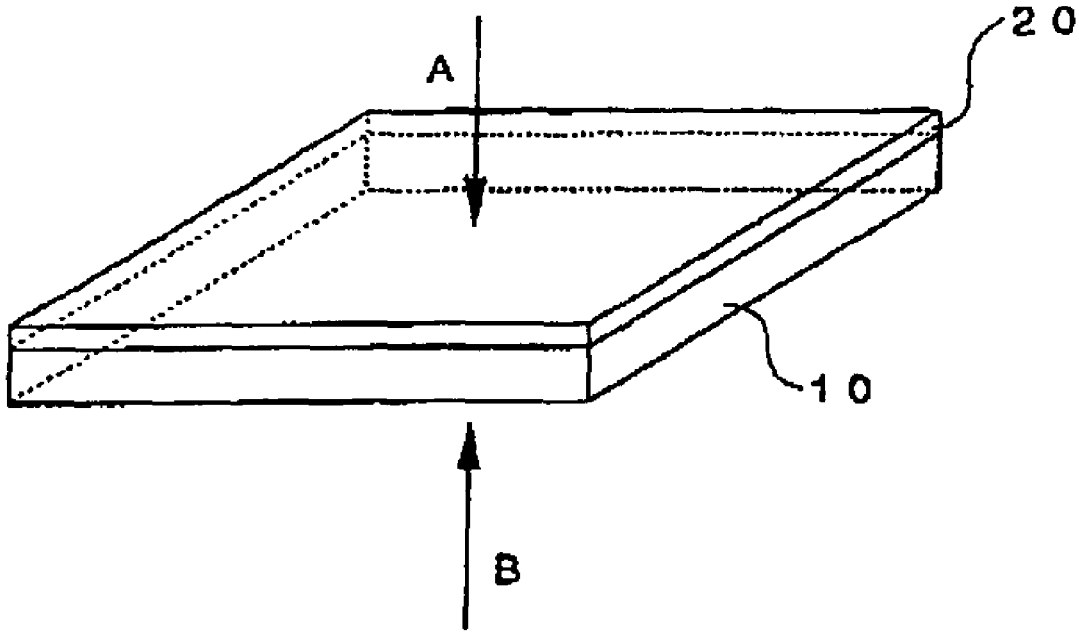
FIG. 1 is a schematic perspective view showing an example of the electrophotographic laminated film of the present invention.

Different features and common features between the electrophotographic laminated film according to the first aspect of the present invention and the electrophotographic laminated film according to the second aspect of the invention will be described at first hereinafter. Both electrophotographic laminated films according to the first and second aspects of the invention are named as the "electrophotographic laminated film of the invention".

The electrophotographic laminated film according to the first aspect of the invention (may be abbreviated as "laminated film" hereinafter) has at least a coating layer on the surface of a substrate. The surface resistance of the uppermost layer of the coating layer is in a range of $1.0\times10^{8}$ to $1.0\times10^{13}$ Ω/□, and at least one surface of the substrate comprises at least one of a polycarbonate resin and a polyallylate resin.

The material contained at least on the surface of the substrate of the laminated film of the first aspect of the invention is not particularly restricted so long as the material is the polycarbonate resin and/or the polyallylate resin. However, the polycarbonate resin and/or the polyallylate resin should be contained on the surface at the side where a coating layer is formed on the substrate. Preferably, the entire substrate or the entire surface of the substrate comprises the polycarbonate resin and/or the polyallylate resin.

Allowing the substrate to contain the polycarbonate resin and/or the polyallylate resin at least on the surface of the laminated film according to the first aspect of the invention permits the surface of the substrate to be excellent in compatibility with the resins contained in the coating liquid, when a coating layer is formed by applying the coating liquid on the surface of the substrate. Consequently, the coating layer provided in contact with the surface of the substrate is tightly adhered on the surface of the substrate to enable the coating layer to be prevented from being peeled from the surface of the substrate. The interface between the surface of the substrate and the coating layer cannot be completely peeled even when the coating layer happens to be peeled. Therefore, forgery of the card can be reliably prevented by producing the card using the laminated film on the core film.

The polycarbonate resin and polyallylate resin are advantageous not only in that they have good compatibility with the coating liquid, but also in that they are readily available with low material costs among the resins available as substrates. Therefore, the laminated film and cards using the laminated film can be readily produced using existing manufacturing apparatus.

Polycarbonate is a condensation polymer obtained from bisphenols and carbonic acid, while polyallylate is a polyester obtained by polycondensation between the bisphenol and an aromatic dicarboxylic acid. Polyallylate usually has better heat resistance than polycarbonate since the former contains rigid aromatic rings in high density in the main chain.

Examples of the bisphenol include bisphenol A (2,2-bis(4-hydroxyphenyl)propane), bisphenol C (4,4'-(1-methylethylidene)bis(2-methylphenol)), bisphenol AP (4,4'-(1-phenylethylidene)bisphenol), bisphenol Z (4,4'-cyclohexylidenebisphenol), 4,4'-cyclobexylidenebis(3-methylphenol), 5,5'-(1-methylethylidene)(1,1'-biphenyl)-2-ol, (1,1'-biphenyl)-4,4'-diol, 3,3'-dimethyl(1,1'-biphenyl)-4,4'-diol, 4,4'-(1,4-phenylenebis(1-methylethylidene)bisphenol), 4,4'-(1,4-phenylenebis(1-methylethylidene)bis(2-methylphenol)), 4,4'-(1,3-phenylenebis(1-methylethyldene)bis(2-methylphenol)), and bisphenol S (4,4'-bis(dihydroxydiphenylsulfone)). Bisphenol A is frequently used among them. These bisphenols may be used alone, or as a combination thereof.

Examples of the dicarboxylic acid include terephthalic acid, isophthalic acid, oxalic acid, malonic acid, succinic acid, adipic acid, itaconic acid, azelaic acid, cebacic acid, eicosane dicarboxylic acid, naphthalene dicarboxylic acid, diphenic acid, dodecane dicarboxylic acid and cyclohexane dicarboxylic acid. These materials are not always required to be used alone, and at least two kinds of them may be copolymerized. Using a mixture with terephthalic acid and/or isophthalic acid is preferable considering melt processibility and overall performance of the polyallylate obtained. While the mixing ratio of such mixture can be arbitrarily selected, the molar ratio of terephthalic acid to isophthalic acid is preferably 9/1 to 1/9, particularly 7/3 to 3/7 considering melt processibility and performance, and more preferably 1/1.

The laminated film according to the second aspect of the invention is an electrophotographic laminated film having at least one coating layer on the surface of the substrate. The surface resistance of at least the uppermost layer of the coating layer is in a range of $1.0\times10^{8}$ to $1.0\times10^{13}$ Ω/□, and the load deflection temperature of the substrate is at least 115° C.

The load deflection temperature of the substrate should be at least 115° C., and is preferably 120° C. or more.

The load deflection temperature is measured by a method for evaluating softening temperatures of thermoplastic resins by which heat resistance of molded plastic materials is tested. In this measuring method, a test piece in a liquid heat transfer medium is heated under a bent stress, and the load deflection temperature is defined as a temperature when the test piece starts to be softened and shows a predetermined magnitude of deflection.

The load deflection temperature is measured according to ASTM D-648. A test piece with a size of 4 mm in thickness, 10 mm in width and 80 mm in length is used for measuring the load deflection temperature. A pressurizing element with a curvature R of 3.2 mm is placed on the surface (a load point) of the test piece, an weight of 1.8 MPa is loaded on the pressurizing element, and the test piece is heated in an oil bath at a heating speed of 2° C./min. The temperature when the magnitude of deflection at the center of the load is 0.25 mm is defined to be the load defection temperature.

The substrate having a load deflection temperature of less than 115° C. becomes to be poor in tenacity when the laminated film is heated under a commonly used condition for fixing the image, the substrate is jammed by winding on a fixing device when the film is carried out of the fixing device, or the substrate is corrugated after transfer.

The surface temperature of the film in the fixing process is preferably in a range of 95° C. to 120° C., although the temperature depends on the heating condition in the fixing process. The heating condition in the fixing process is preferably controlled so that the surface temperature of the laminated film in the fixing process is in a range of 100° C. to 110° C., in order to more reliably prevent the substrate from winding on the fixing device or from being corrugated after transfer.

Although a higher deflection temperature of the substrate is preferable for preventing the substrate from winding on the fixing device or from being corrugated after transfer, tenacity of the substrate becomes so strong when the deflection temperature is too high that the laminated film cannot be readily peeled from the core film after laminating by heating. Accordingly, the load deflection temperature is preferably 230° C. or less considering the situations as described above.

Common features between the laminated film according to the first aspect of the invention and the laminated film according to the second aspect of the invention will be described hereinafter.

In the electrophotographic laminated film of the invention, at least the uppermost layer of the coating layer provided on the surface of the substrate should have a surface resistance in a range of $1.0\times10^{8}$ to $1.0\times10^{13}$ Ω/□, preferably in a range of $1.0\times10^{9}$ to $1.0\times10^{11}$ Ω/□.

When the surface resistance is less than $1.0\times10^{8}$ Ω/□, the resistance of the laminated film becomes so low when used as a image recording medium at a high temperature and high humidity that, for example, transfer of the toner from a transfer member may be distorted. When the surface resistance exceeds $1.0\times10^{13}$ Ω/□, in contrast to the above, the resistance of the laminated film used as the image recording medium becomes so high that, for example, the toner cannot be transferred from the transfer member onto the surface of the film, thereby generating image defects due to poor transfer of the toner.

The surface of the substrate at the side not provided with the coating layer is preferably in a range of $1.0\times10^{8}$ to $1.0\times10^{13}$ Ω□, more preferably in a range of $1.0\times10^{9}$ to $1.0\times10^{11}$ Ω/□ by the same reason above, when the coating layer is provided only on one surface of the substrate.

The surface resistance can be measured using a circular electrode (for example, trade name: HR probe of High-Lester IP, manufactured by Mitsubishi Chemical Co., Ltd.) under an environment of 23° C. and 55% RH.

It is preferable for the electrophotographic laminated film that, when only one surface of the laminated film has the surface resistance in the range as described above, the image is formed on that surface.

The surface resistance of the coating layer provided on the surface of the substrate, or the surface resistance of the surface of the substrate is controlled in a range of $1.0\times10^{8}$ to $1.0\times10^{13}$ Ω/□ by adding a conductive polymer, surfactant or conductive metal oxide particles in the coating layer as an antistatic agent, by adding the surfactant, conductive polymer or conductive fine particles in the resin in the manufacturing process of the substrate, by coating the surfactant on the surface of the film, by depositing a metal thin layer, or by adding an appropriate amount of the surfactant in an adhesive.

Examples of the surfactant available include cationic surfactants such as polyamines, ammonium salts, sulfonium salts, phosphonium salts and betaine based amphoteric salts; anionic surfactants such as alkyl phosphates; and nonionic surfactants such as fatty acid esters. The cationic surfactants having large interaction with negatively charged toners for use in recently available electrophotography are effective for improving transfer ability among the surfactants described above.

Quaternary ammonium salts are preferable among the cationic surfactants. The following compound represented by the general formula (II) below is preferable as the quaternary ammonium salt.

General Formula (II)

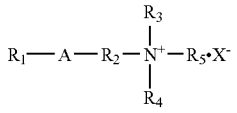

In the formula, $R_1$ represents an alkyl group, an alkenyl group and an alkynyl group having 6 to 22 of carbon atoms; and $R_2$ represents an alkyl group, an alkenyl group and an alkynyl group having 1 to 6 of carbon atoms. $R_3$, $R_4$ and $R_5$ may be the same or different with each other, and each represents an aliphatic group, an aromatic group or a heterocyclic group. The aliphatic group denotes a linear branched or cyclic alkyl group, alkenyl group or alkynyl group. The aromatic group denotes a benzene ring and condensed polycyclic allyl group. These groups may have substituents such as a hydroxyl group. While A represents an amide bond, an ether bond, an ester bond or a phenyl group, while A may be omitted. $X^-$ represents a halogen atom, a sulfate ion or a nitride ion, and these ions may have substituents.

While the constitution of the laminated film of the invention is not particularly restricted so long as it comprises at least one coating layer on the surface of the substrate, examples of the laminated film of the invention will be described in detail below. However, it is needless to say that the constitution of the laminated film of the invention is not restricted to that schematically shown below.

FIG. 1 is a schematic perspective view as an example of the electrophotographic laminated film of the invention. The electrophotographic laminated film of the invention shown in FIG. 1 comprises a substrate 10 and function control means 20. The film may further comprise an image receiving layer (coating layer; not shown), if necessary, on the surface where the function control means 20 is not provided on the substrate 10.

While the function control means 20 is represented as having a layer structure (coating layer) in FIG. 1, the configuration is not restricted thereto, and the function control means 20 may be directly provided on the surface of the substrate 10 by mechanical processing of the surface of the substrate 10. However, a coating layer (not shown) is independently provided on the surface of the substrate 10, when the function control means 20 is formed by mechanical processing of the surface of the substrate 10.

An inverse image (mirror image) is formed on the surface of the transparent substrate 10 in the electrophotographic laminated film of the invention, so that the image is seen as a normal image by observing the image from the side surface opposed to the image forming surface through the substrate 10. The function control means 20 is further provided on the surface at the side where no inverse image is formed. In other words, the image is formed from the side as indicated by arrow B, and a luster control means (function control means 20) is provided on the surface indicated by arrow A. According to the electrophotographic laminated film as described above, the quality of the image formed is not adversely affected by the function control means, since the image forming surface and the surface for providing the luster control means are different on the substrate. Consequently, various functions can be simultaneously controlled.

The substrate 10 applicable for the electrophotographic laminated film of the invention is desirably transparent. The term "transparent" is used herein refers to a property in which a visible light is transmitted to some extent. The substrate may be transparent to an extent capable of observing at least the image formed by naked eyes through the substrate 10 from the opposed face to the image forming face.

When the laminated film according to the first aspect of the invention as the substrate 10 comprises the polycarbonate resin and/or the polyallylate resin on the surface of the substrate 10, and when the substrate 10 has a construction comprising at least two layers of the film, the substrate may comprise the polycarbonate and/or polyallylate films and plastic films as shown below.

Examples of the plastic films include light-permeable films applicable as OHP films such as polyester film, polyacetate film, cellulose triacetate film, nylon film, polyester film, polysulfone film, polystyrene film, polyphenylene sulfide film, polyphenylene ether film, cycloolefin film, polypropylene film, polyimide film, cellophane, and ABS (acrylonitrile-butadiene-styrene) resin film.

Favorably used films among the polyester films are a so-called PETG film in which about half of the ethyleneglycol component of PET (polyethylene terephthalate) is replaced with the 1,4-cyclohexane methanol component, an alloy film in which polycarbonate is mixed with PET, and an amorphous polyester film that is a PET film not subjected to biaxial drawing and is called as A-PET film.

The plastic film materials listed above are able to cope with the situations that polyvinyl chloride that has been used for substrates (cores) of conventional cards have been recognized to be not environmentally soft because it generates dioxin by combustion at disposing a combustible material, and use of polyvinyl chloride has been avoided With respect to the above points, substrates that comprise resin(s) comprising a non-chlorine resin as a principal component, and further, resin(s) comprising no chlorine are preferably used in the invention. Such substrates may include, for example, the polystyrene resin films, ABS resin films, and AS (acrylonitrile-styrene) resin films as well as films in which polyester or EVA hot-melt adhesives are added to the polyolefin resin films such as PET films, polyethylene films and polypropylene films.

The materials available for combining with the polycarbonate film and/or polyallylate film include, in addition to the plastic films above, other transparent resins and ceramics. These materials may be colored by adding a pigment or dye. The substrate 10 may be a film or sheet, or may have a thickness to an extent not to be flexible, or to have a strength enough for complying with the requirement as the substrate (10).

In contrast to the above, the material constituting the substrate 10 is not particularly restricted so long as the material has a load deflection temperature of at least 115° C. as the laminated film according to the second aspect of the invention, and one or at least two kinds of the conventional resin materials as the plastic films described above may be used in combination. For example, the polycarbonate resin or polyallylate resin, or a film containing at least the polysulfone resin, polyphenylene ether resin and cycloolefin resin may be used as the substrate 10. The film comprising only these resins is suitable.

The polysulfone resin, polyphenylene ether resin and cycloolefin resin are favorable materials like the polycarbonate resin and polyallylate resin from the view point of compatibility with the coating liquid. It is preferable to allow these resins to be contained in the surface at least at the side of the substrate 10 on which the coating layer is formed, when these resins are used as the materials constituting the substrate 10.

The polysulfone resin has —$SO_2$— groups in the main chain, and is obtained by polycondensation of dichlorophenyl sulfone and bisphenol A. A polysulfone film manufactured by Solvay Advanced Polymer Co. (load deflection temperature: 174° C.) may be used for the substrate 10.

The polyphenylene ether resin is a polymer having a basic repeating unit represented by —$C_6H_4$—O—, and examples of practically available resin include 2,6-dimethylphenylene ether. A commercially available film such as Ubiace AR60 manufactured by Mitsubishi Plastics, Inc. (load reflection temperature: 120° C.) may be used for the substrate 10.

An example of the commercially available film using the cycloolefin resin for the substrate 10 is Zeonex 480 (trade name, manufactured by Nippon Zeon Co., Ltd.), that having a load reflection temperature of 123° C.

The function control means 20 preferably has at least one function selected from the functions for controlling luster, light stability, antibacterial property, fire retardancy, releasing property and electrostatic property. For example, the function controlling means is provided for giving and/or improving various functions such as luster, light stability, antibacterial property, fire retardancy, releasing property and conductive property as well as preferably moisture resistant, heat resistant, water repelling, wear resistant and scratch resistant properties of the surface of the substrate 10. Consequently, the electrophotographic laminated film having the function control means 20 becomes to be resistant to various applicaion condtions.

While the function control means 20 for controlling luster is described below as an example, the present invention is not restricted thereto.

Luster of the film is controlled so as to suppress glittering of images formed on the surface of the substrate 10 so that recognition of vision may be improved as viewed from any angles of vision. For example, the function control means 20 for controlling luster may comprise a luster control layer provided on the surface of the substrate 10, or the substrate 10 may have a luster control function by applying mechanical processing for directly controlling luster on the surface of the substrate 10.

The surface of the substrate 10 is roughened by a mechanical means in the method for directly controlling luster of the surface of the substrate 10 by mechanical processing. The light is scattered on the surface of the substrate by forming concave and convex portions on the surface of the substrate with a depth of troughs of about 3 to 30 μm. Luster of the surface may be arbitrarily controlled by changing the size, roughness and depth of the roughened surface. The mechanical processing methods include a sand blast method, embossing method, plasma etching method and other mechanical surface processing methods known in the art.

In the sand blast method, the surface is roughened by blasting amorphous or crystalline particles of organic resins, ceramics or metals as grinding particles. In the embossing method, a mold having a roughened pattern is previously prepared, and the roughened pattern is transferred onto the surface of the material by allowing the mold to contact the material. In the plasma etching method, the surface is etched by taking advantage of excited molecules, radicals or ions generated as a result of molecular dissociation by plasma discharge. Etching of the material advances by evaporation of volatile compounds formed by a reaction between excited species generated and the material.

When the function control means 20 for controlling luster is formed as a luster control layer, the layer may be formed by taking advantage of phase separation of the polymer. In this method, a resin having no compatibility with the resin constituting the luster control layer is added in the resin, and the surface is roughened by permitting phase separation to arise in the resin during the drying process after forming the layer. The phase separation state can be changed by controlling the kind and amount of addition of the incompatible resin and drying conditions, thereby controlling luster of the surface.

When the function control means 20 for controlling luster is formed as the luster control layer, the luster control layer may comprise at least a bonding agent and filler. Resins may be used as the bonding agent added in the luster control layer. This resin preferably comprises a thermal-fusible resin used for the image forming material (toner) considering affinity with the substrate, diversity of selection of materials, stability, cost and easiness of manufacturing process. The thickness of the luster control layer is preferably in a range of 0.01 to 20 μm for stably forming the layer, and is more preferably in a range of 0.1 to 5 μm for ensuring an adhesive property with the substrate.

While the thermal-fusible resins used for the coating layers as the function control means 20 and image receiving layer are not particularly restricted so long as they are available as the image forming material, examples of them include homopolymers or copolymers obtained by polymerizing one or more monomers such as styrenes such as styrene, vinylstyrene and chlorostyrene; monoolefins such as ethylene, propylene, butylene and isobutylene; vinyl esters such as vinyl acetate, vinyl propionate, vinyl benzoate and vinyl butylate; esters of α-unsaturated aliphatic monocarboxylic acid such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate: vinyl ethers such as vinylmethyl ether, vinylethyl ether and vinybutyl ether; vinylketones such as vinylemthyl ketone, vinylhexyl ketone and vinylisopropenyl ketone; and diene monomers such as isoprene and 2-chlorobutadiene.

Styrenes and esters of α-unsaturated aliphatic monocarboxylic acid are preferably used among them.

The polyester and polyurethane resins may be used alone or a mixture as the thermoplastic resins to be used in the invention.

The polyesters above can be produced by a reaction between a polyfunctional hydroxyl compound and a polybasic carboxylic acid or its reactive acid derivative. Examples of the polyfunctional hydroxyl compound constituting the polyester include diols such as ethyleneglycol, diethyleneglycol, triethyleneglycol, 1,2-propyleneglycol, 1,3-propyleneglycol, neopentylglycol and 1,4-butanediol; bisphenol A alkylene oxide adducts such as hydrogenated bisphenol A, polyoxyethylene adduct of bisphenol A and polyoxypropylene adduct of bisphenol A; and divalent phenols such as divalent alcohol adduct of bisphenol A.

Examples of the polybasic carboxylic acid include divalent carboxylic acids such as malonic acid, succinic acid, adipic acid, sebacic acid, alkylsuccinic acid, maleic acid, fumaric acid, mesaconic acid, citraconic acid, itaconic acid, glutaconic acid, cyclohexane dicarboxylic acid, phthalic acids (isophthalic acid and terephthalic acid), and other divalent carboxylic acids, or reactive acid derivatives such as anhydrides, alkyl esters and acid halides. Trivalent or more of polyvalent hydroxyl compounds and/or trivalent or more of polybasic carboxylic acids may be added in addition to these divalent hydroxyl compounds and carboxylic acids, in order to make the thermoplastic resins obtained to be non-linear to an extent not forming tetrahydrofuran insoluble products.

The resin particularly preferable among them is a linear saturated polyester resin prepared by using phthalic acid as the divalent carboxylic acids, and ethyleneglycol and neopentylglycol as the polyhydroxy compounds, and by polycondensation of these compound in a predetermined composition ratio. The composition ratio of terephthalic acid to isophthalic acid is 1:1, and the composition ratio of ethyleneglycol to neopentylglycol is in a range of 7:3 to 1:9. The divalent carboxylic acid and polyhydroxyl compound are desirably polymerized is in a mixing ratio of 1:1.

The resin constituting the luster control layer may comprise heat-curable resins, photo-curable resins or electron beam curable resins for enhancing the strength of the coating layer.

Resins that are commonly known to be hardened (insolubilized) by beating are used as the heat-curable resin. They are, for example, phenol-formaldehyde resin, urea-formaldehyde resin, melamine-formaldehyde resin, resins obtained by curing acrylic polyol with isocyanate, resins prepared by curing polyester polyol with melamine, and resins prepared by curing acrylic acid with melamine. Monomers as constituents of heat-curable resins may be used in combination.

Any thermoplastic resins hardened by cross-linking and being heat resistant may be used as the heat-curable resin of the invention. Thermosetting acrylic resins are preferably used as the heat-curable resin. The heat-curable acrylic resin is prepared by cross-linking a polymer prepared by polymerizing at least one of acrylic monomers, or a copolymer prepared by copolymerizing an acrylic monomer and a styrene monomer with melamine or isocyanate compounds.

Examples of acrylic monomers available include methacrylic acid alkyl esters such as methyl methacrylate, butyl methacrylate, octyl methacrylate and stearyl methacrylate; acrylic acid alkyl esters such as ethyl acrylate, propyl acrylate, butyl acrylate and octyl acrylate; vinyl monomers containing amino groups such as acrylonitrile, acrylamide, methacrylic acid dimethylaminoethyl ester, methacrylic acid diethylaminoethyl ester, acrylic acid dimethylaminoethyl ester and dimethylaminopropyl methacrylamide. Examples of the styrene monomers available include styrene, α-methylstyrene, vinyltoluene and p-ethylstyrene.

While hardening is not restricted to heat-curing, curable silicone resins may be also preferably used. The silicon resins are usually classified into silicone resins having linear structures that serve as materials of silicone oils and silicone rubbers, and silicone resins having three dimensionally cross-linked structures depending on their molecular structures, Properties such as releasing ability, adhesive property, heat resistance, insulation property and chemical stability are determined by the molecules (organic molecules) bonded to silicon atoms and degree of polymerization. The curable silicone resins available in the invention is those having the three dimensional cross-linking structure. The silicone resin having the three dimensional cross-linking structure is usually prepared by polymerization of polyfunctional (three or four functional) units and has a cross-linked structure.

Although examples of the silicone resin having the linear structure include low molecular weight silicone resins that are used for an insulation oil, liquid coupling agent, buffer oil, lubricating oil, heat-transfer oil, water repellent, surface treatment agent, releasing agent and antifoaming agent, and silicone rubber polymerized to a degree of polymerization (in siloxane unit) of 5,000 to 10,000, neither of them are suitable as the curable silicone resin.

The curable silicone resins are classified into silicone varnish soluble in organic solvents and having a relatively low molecular weight, and silicone resins having a relatively high degree of polymerization depending on their molecular weight. The curable silicone resins are also divided into condensation, addition, radiation (UV curable and electron beam curable) type resins depending on their curing reactions in the manufacturing process. They are also divided in solvent type and non-solvent type depending on the method of coating.

The factors governing the curing reaction include the kinds of reactive groups, the number of reactive groups, the curing time, temperature and irradiating energy. Examples of the method for controlling the curing reaction include adding monofunctional or bifunctional polydimethyl siloxane, reaction suppressing agent (such as acetylene alcohol, cyclic methylvinyl cyclosiloxane, siloxane denatured acetylene alcohol), and controlling the amount of a catalyst, reaction temperature, reaction time and UV irradiation intensity. Since the molecular weight and residual amount of silanol as reactive groups can be controlled by controlling the curing reaction, it is possible to freely control the releasing ability, hardness, adhesive property, surface hardness, transparency, heat resistance and chemical stability.

Tight bonds are formed between the substrate 10 and curable silicone resin in the step for curing the curable silicone resin. Accordingly, the luster control layer formed on the surface of the substrate 10 is not peeled off from the substrate 10, because the layer has an excellent adhesive strength to the substrate 10.

The composition using the photo-curable resin comprises, for example, a compound having reactive double bonds such as vinyl groups in the molecule (a low molecular weight compound as well as a high molecular weight compound), an initiator required for initiation of photo-curing, an underlayer (coloring layer or substrate layer, if necessary) protective material such as a ultraviolet ray absorber, and a resin for improving sheet retaining property, if necessary, as principal components.

The composition using the electron beam curable resin contains, as principal components, a compound having reactive double bonds such as vinyl groups in the molecule, underlayer protective material (ultraviolet ray absorber), and a resin, if necessary.

Examples of the compounds having reactive double bonds in the molecule include monofunctional compounds having (meth)acryloyl groups such as methyl(meth)acrylate, ethyl (meth)acrylate, benzyl(meth)acrylate, 2-ethoxyethyl(meth) acrylate, and phenoxydiethyleneglycol(meth)acrylate, and polyfunctional compounds such as 1,6-hexanediol (meth) acrylate, neopentylglycol di(meth)acrylate, polyethyleneglycol di(meth)acrylate, polypropyleneglycol di(meth)acrylate, trimethylpropane tri(meth)acrylate, pentaerythritol tri (meth)acrylate, pentaerythritol tetra(meth)acrylate and dipentaerythritol hexa(meth)acrylate. They also include oligomers such as polyester acrylate, polyurethane acrylate, polyapoxy acrylate, polyether acrylate, oligo acrylate, polyalkyl acrylate and polyol acrylate. The examples also include unsaturated compounds having vinyl or ally groups such as styrene monomer, α-methyl styrene, divinylbenzene, vinyl acetate, pentene and hexene.

Polar groups such as hydroxyl group, amino group, carboxyl group, carbonyl group and epoxy group may be introduced for improving the adhesive property with the luster control layer and compatibility with the underlayer protective material.

The photo-curing polymerization initiator is particularly added for UV curing. The photo-curing polymerization initiator is usually called as a photo-initiator, and examples of the favorably used photo-initiator include benzoin alkylether, acetophenone, benzophenone and thioxanthone photo-initiators. Examples of the benzoin ether initiators include benzyl, benzoin, benzoin methylether, benzoin ethylether and benzoin propylether. Examples of the acetophenone initiator include 2,2'-diethoxyacetophenone, 2-hydroxy-2-methylpropiophenone, p-tert-butyl trichloroacetophenone, and 2,4,6-trimethylbenzoyl diphenylphosphine oxide. Examples of the benzophenone initiator include benzophenone, 4-chlorobenzophenone, 4,4'-dichlorobenzophenone, 3,3'-dimethyl-4-methoxybenzophenone, and dibenzosuberenone. Examples of thioxanthone initiator include thioxanthone, 2-chlorothioxanthone, 2-methylthioxanthone, 2-isopropylthioxanthone and 2-ethylanthraquinone.

The photo-initiator is added in a proportion of in a range of 0.05 to 10 parts by weight, preferably 0.1 to 5 parts by weight, relative to 100 parts by weight of the compound having the reactive double bonds. The photo-initiator is not restricted to one kind, and at least two kinds of them may be added.

Commercially available ultraviolet ray absorbers may be used for protection of the underlayer light, particularly as the light resistant material. Materials having good dispersion stability in the composition and being not deteriorated by irradiating the light are selected as the materials added. Examples of organic materials include salicylic acid compounds such as phenyl salicylate, p-tert-butylphenyl salicylate and p-octylphenyl salicylate; benzophenone compounds such as 2,4-dihydroxybenxophenone, 2-hydroxy-4-methoxybenzophenone, 2-hydroxy-4-octylbenzophenone and 2-hydroxy-4-didecyloxybenzophenone; and benzotriazole compounds such as 2-(2'-hydroxy-5'-methylphenyl)2H-benzotriazole, 2-(2'-hydroxy-5'-tert-butylphenyl)benzotriazole, and 2-(2'-hydroxy-3'-tert-butyl-5'-methylphenyl)-5-chlorobenzotriazole; and cyanoacrylate compounds such as 2-ethylhexyl-2-cyano-3,3'-diphenylacrylate and ethyl-2-cyano-3,3'-diphenylacrylate.

Examples of inorganic materials include fine particles of oxides such as zinc oxide and titanium oxide, and fine particles of metal oxides such as iron oxide and cerium oxide.

The organic materials are preferable as the ultraviolet ray absorber, and they are added in a proportion of 0.01 to 40 parts by weight, preferably 0.1 to 25 parts by weight, relative to 100 parts by weight of the compound having the reactive double bonds. Not only one kind of the UV absorbed, but also at east two kinds of the ultraviolet ray absorbers are preferably added in order to obtain good underlayer protective effect.

It is also preferable to add hindered amine light stabilizers and antioxidants in some cases.

Commercially available antioxidants may be used as another light resistant material for protecting the underlayer.

The materials added are selected from the materials having good dispersion stability in the composition and being not deteriorated by irradiating a light, as in the ultraviolet ray absorber. Examples of the material are phosphate, sulfur, phenol and hindered amine antioxidants.

Specific examples of the phosphate antioxidant include phosphite ester compounds such as trimethyl phosphite, triethyl phosphite, tri-n-butyl phosphite, trioctyl phosphite, tridecyl phosphite, tristeryl phosphite, trioleyl phosphite, tris-tridecyl phosphite, tricetyl phosphite, dilaurylhydrodiene phosphite, diphenylmonodeyl phosphite, diphenylmono (tridecyl)phosphite, tetraphenyl dipropyleneglycol phosphite, 4,4'-butylidene-bis[3-methyl-6-t-(butyl)phenyl-di-tridecyl]phosphite, distearyl pentaerythritol diphosphite, tridecyl pentaerythritol diphosphite, bisnonylphenyl pentaerythritol diphosphite, diphenyloctyl phosphite, tetra (tridecyl)-4,4'-isopropylidenediphenyl phosphite, tris(2,4-di-t-butylphenyl)pentaerythritol diphosphite.

All trivalent organic phosphate compounds known in the art as the phosphate antioxidants may be used, and examples of them are described in Japanese Patent Application Publication (JP-B) Nos. 51-40589, 51-25064, 50-35097, 49-20928, 48-22330 and 51-35193.

Examples of the sulfur antioxidant include di-n-dodecyl 3,3'-thiodipropioate, di-myristyl 3,3'-thiodipropioate, di-n-octadecyl 3,3'-dipropioate, 2-mercaptobenzimidazole, pentaerythritol tetrakis(β-lauryl, urylthiopropionate), ditridecyl 3,3'-thiodipropionate, dimethyl 3,3'-thiodipropionate, octadecyl thioglycolate, phenothiazine, β,β'-thiodipropionoc acid, n-butyl thioglycolate, ethyl thioglycolate, 2-ethylhexyl thioglycolate, isooctyl thioglycolate, n-octyl thioglycolate, di-t-dodecyldisulfide, n-butyldisulfide, di-n-amyldisulfide, nododecylsulfide, n-octadecylsulfide, and p-thiocresol.

Examples of phenol antioxidants include 2,6-di-t-butyl-p-cresol (BHT), 2,6-di-t-butylphenol, 2,4-di-methyl-6-t-butylphenol, butylhydroxyphenol, 2,2'-methylenebis(4-methyl-6-t-butylphenol), 4,4'-thiobis(3-methyl-6-t-butylphenol), bisphenol A, DL-α-tocopherol, styrene adduct of phenol, styrene adduct of cresol, 3,5-di-t-butylhydroxy benzaldehyde, 2,6-di-t-butyl-4-hydroxymethyl phenol, 2,6-di-s-butylphenol 2,4-di-t-butylphenol, 3,5-di-t-butylphenol, o-n-butoxyphenol, o-t-butylphenol, m-t-butylphenol, p-t-butylphenol, o-isobutoxyphenol, o-n-propoxyphenol, o-cresol, 4,6-di-t-butyl-3-methylphenol, 2,6-dimethylphenol, 2 3,5,6-tetramethylphenol, stearyl 3-(3', 5'-di-t-butyl-4'-hydroxyphenyl)propionate, 2,4,6-tri-t-butylphenol, 2,4,6-trimethylphenol, 2,4,6-tris(3',5'-di-t-butyl-4'-hydroxybenzyl)mesitylene, 1,6-hexanediol-bis[3-(3,5-di-t-butyl-4-hydroxyphenol)propionate], 2,2-thio-dienebis(3-[(3,5-di-t-butyl-4-hydroxyphenyl)propionate], 2,2-thiobis (4-methyl-6-t-butylphenol), 3,5-di-t-butyl-4-hydroxy-benzylphosphetol, o-n-propoxyphenol, o-cresol, 4,6-di-t-butyl-3-methylphenol, 2,6-dimethylphenol, 2,3,5,6-tetramethylphenol, stearyl 3-(3',5'-di-t-butyl-4'-hydroxyphenyl)propionate, 2,4,6-tri-t-butylphenol, 2,4,6-trimethylphenol, 2,4,6-tris(3',5'-di-t-butyl-4'-hydroxybenzyl)mesitylene, 1.6-hexanediol-bis[3-(3,5-di-t-butyl-4-hydroxyphenyl)]propionate, 2,2-thio-diethylenebis [3-(3,5-di-t-butyl-4-hydroxyphenyl)propionate], 2,2-thiobis (4-methyl-6-t-butylphenol), diethyl 3,5-di-t-butyl-4-hydroxy-benzylphosphate-diethyl ester, 1,3,5-trimethyl-2,4,6-tris(3,5-di-t-butyl-4-hydroxybenzyl)benzene, n-octadecyl-3-(3',5-di-t-butyl-4-hydroxyphenyl)propionate, 2-t-buytl-6-(3'-t-butyl-5'-methyl-2-hydroxybenzyl)-4-methylphenyl acrylate, 4,4'-butylidene-bis(3-methyl-6-t-butylphenol), hydroquinone, 2,5-di-t-butyl hydroquinone, and tetramethyl hydroquinone.

Examples of the hindered amine antioxidants include bis(2,2,6,6-tetramethyl-4-piperidyl)sebacate, bis (1,2,2,6,6-pentamethyl-4-piperidyl)sebacate, 1-{2-[3-(3,5-di-t-butyl-4-hydrophenyl)propionyoxy]ethyl}-4-(3,5-di-t-butyl-4-hydroxyphenyl)propionyloxy-2,2,6,6-tetramethylpyridine, 8-benzyl-7,7,9,9-tetramethyl-3-octyl-1,3,8-triazaspiro[4,5] undecane-2,4-dione, benzoyloxy-2,2,6,6-tetramethylpiperidine, 2,2,6,6-tetramethyl-4-piperidinol, and tetrakis(2a2,6,6-tetramethyl-4-piperidil/decyl)-1,2,3,4-butane tetracarboxylate.

These antioxidants may be used alone, or as a mixture of at least two of them.

Frame retarding property is given so as to be durable to the flame applied from the control surface side. The flame retarding material include addition type flame retardants such as halogen, phosphorous and other inorganic flame retardants.

Examples of the halogen flame retardants include bromine flame retardants such as tetrabromobisphenol A (TBA), hexabromobenzene, decabromodiphenyl ether, tetrebromoethane (TBE), trabromobutane (TBB), hexabromocyclodecane (HBCD), and chlorine flame retardants such as chlorinated paraffin, chlorinated polyphenyl, chlorinated diphenyl, perchloropentacyclodecane, and chlorinated naphthalene. These compound can be more effected by using antimony trichloride.

Examples phosphorous flame retardants include tricresil phosphate, tri(β-chloroethyl)phosphate, tri(dichloropropyl. phosphate, tri(dibromopropyl)phosphate, and 2,3-dibromopropyl-2,3-chloropropyl phosphate.

Examples of inorganic flame retardants include aluminum hydroxide, magnesium hydroxide, phosphate esters or halogenated phosphate esters, zirconium hydroxide, basic magnesium carbonate, dolomite, hydrotalcite, calcium hydroxide, barium hydroxide, hydrates of inorganic metal compounds such as hydrated tin oxide and borax, zinc borate, zinc metaborate, barium metaborate, zinc carbonate, magnesium calcium carbonate, calcium carbonate, barium carbonate, magnesium oxide, molybdenum oxide, tin oxide and red phosphorous. A hydrate of at least one metal compound selected from the group comprising aluminum hydroxide, magnesium hydroxide, zirconium hydroxide, basic magnesium carbonate, dolomite and hydrotalcite, particularly aluminum hydroxide and magnesium hydroxide, have higher flame retarding effect, and are economically advantageous.

While the preferable particle diameter of the inorganic flame retardant differs depending on the kind of the compound, the mean particle diameter is 20 μm or less, preferably 10 μm or less, in aluminum hydroxide and magnesium hydroxide.

These flame retardants may be used alone, or as a mixture of at least two of them.

When the halogen and phosphorous flame retardants are selected as the flame retardant, they are blended so that the total amount thereof is preferably in a range of 5 to 50 parts by weight, more preferably in a range of 6 to 40 parts by weight. A high degree of flame retarding effect cannot be obtained when the proportion is less than 5 parts by weight, while the flame retarding effect is not so improved even by blending an amount exceeding 50 parts by weight and addition of such amount of flame retardant is rather uneconomical.

When the inorganic flame retardants are selected as the flame retarding material, the proportion of blending is desirably in a range of 30 to 200 parts by weight, more preferably in a range of 40 to 150 parts by weight, relative to 100 pats by weight of the resin. The inorganic flame retardant should be used together with an organic flame retardant when the amount of blending of the former is less than 30 parts by weight, because a sufficient flame retarding effect cannot be obtained by the inorganic flame retardant alone. In contrast to the above, when the amount of blending exceeds 200 parts by weight, wear resistance becomes poor, mechanical strength such as shock resistance decreases, flexibility is lost, and low temperature characteristics become poor.

The inorganic flame retardant is particularly useful as the flame retardant by taking advantage of no generation of toxic halogen gases by incineration.

Since polymers as the sheet retention improving materials are added for improving handling (flexibility) of the sheet and for improving tackiness of the surface of the sheet, and have no reactive double bonds, a material having good compatibility with a compound having double bonds is selected. For example, when the compound having double bonds has a urethane frame and (meth)acryloyl groups, an acrylic resin, a polyester resin and a urethane resin comprising methacrylate can be used. A guideline for selecting the polymer is SP (solubility parameter), and a combination of materials having closer SP values with each other is preferable. Fluorine resins and silicone resins are used as the polymer in addition to the materials described above.

Polar groups such as hydroxyl groups, amino groups, carboxyl groups, carbonyl groups and epoxy groups are introduced into the polymers as the sheet retention improving materials, in order to improve adhesive property of the luster control layer with the substrate 10, and in order to improve compatibility with the underlayer protective material. An peroxide may be added to the luster control layer, if necessary. While conventional organic peroxides may be used in the luster control layer, organic peroxides with a decomposition temperature of 100° C. or more are preferable considering stability of storage at room temperature.

Specific examples of the peroxide include 2,2-bis(tert-butylperoxy)butane, tert-butylperoxy benzoate, di-tert-butylperoxy isophthalate, methylethyl ketone peroxide, dicumyl peroxide, and tert-butylperoxy acetate. The amount of addition of the peroxide is preferably in a range of 0.5 to 5.0 parts by weight relative to 100 parts by weight of the low molecular weight compound having the (meth)acryloyl group. Not only one kind of the peroxide, but also at least two kinds of the peroxides may be used together. Adding these peroxides permits the portion hardly hardened by irradiation of light to be hardened by heating.

A water soluble binder may be used as the binder constituting the luster control layer in place of the resin. Examples of the water soluble binder available include water soluble polymers such as oxidized starch, starch phosphate, cationic starch, self-degenerated starch and various degenerated starch, polyethylene oxide, polyacylamide, sodium polyacrylate, sodium arginate, hydroxyethyl cellulose, methyl cellulose, polyvinyl alcohol or derivatives thereof. These water soluble resins may be used as a mixture of several kinds of them depending on the objects.

A small amount of coloring agent such as a pigment and dye, and high rigidity fine particles for enhancing the hardness may be added, if necessary, to the luster control layer. Any pigment and dyes used in paints may be used as the coloring agent. Examples of the pigment include titanium oxide, iron oxide, carbon black, cyan pigments and quinacridone pigments. Examples of the dye include azo dyes, anthraguinone dyes, indigoid dyes and stilbene dyes. Metal powders such as aluminum flake, nickel powder, gold powder and silver powder may be used as the coloring agent. These materials are preferably as fine as possible. Fine particles (volume average particle diameter of 20 nm or less) of titanium oxide, silica and diamond are used, if necessary, for improving hardness. The photo-initiator being able to initiate the reaction with a light having a wavelength less that is less absorbed by the coloring agent is preferably used, when these coloring agents are added.

Examples of combination of the materials mainly comprising acrylic materials for the luster control layer will be described below. Other materials may be also combined as described below.

I: a photo-curable luster control layer mainly comprising (a) an acrylic resin having a mass average molecular weight in a range of 20,000 to 1,000,000, and being a solid at room temperature, (b) a low molecular weight compound having double bonds in the molecule, and (c) a photo-initiator;

II: a photo-curable luster control layer mainly comprising (d) an acrylic resin having a plurality of functional groups selected from a group comprising hydroxyl group, amino group and carboxyl group in the molecule, having a mass average molecular weight in a range of 20,000 to 1,000,000, and being a solid in room temperature, (b) a low molecular weight compound having double bonds in the molecule, (c) a photo-initiator, and (e) at least one cross-linking agent selected from a group comprising an isocyanate cross-linking agent, a melamine cross-linking agent and an epoxy cross-linking agent;

III: a photo-curable luster control layer mainly comprising (f) an acrylic resin having a plurality of reactive double bonds in the molecule, having amass average molecular weight in a range of 20,000 to 1,000,000, and being a solid at room temperature, and (b) a low molecular weight compound having double bonds in the molecule, (c) a photo-initiator; and IV: a photo-curable luster control layer mainly comprising (g) an acrylic resin having at least one functional group selected from a group comprising hydroxyl group, amino group and carboxyl group and a plurality of reactive double bonds, having a mass average molecular weight in a range of 20,000 to 1,000,000, and being a solid at room temperature, (b) a low molecular weight compound having double bonds in the molecule, (c) a photo-initiator, and (e) at least one cross linking agent selected form the group comprising an isocyanate cross-linking agent, a melamine cross-linking agent and an epoxy cross-linking agent.

In the electron beam curable luster control layer, the photo-initiator is omitted from the bend of the luster control layer using the photo-curable resin.

The acrylic resin (a) having the mass average molecular weight of 20,000 to 1,000,000 and being a solid at room temperate shown in the blend of the luster control layer can be obtained by polymerizing, for example, (meth)acrylic acid esters such as methyl (meth)acrylate, ethyl (meth) acrylate and butyl (meth)acrylate, with a styrene derivative monomer or maleic acid monomer in the presence of a reaction initiator (peroxide or chain reaction transfer agent).

The acrylic resin (d) having a plurality of functional groups selected from a group comprising hydroxyl group, amino group and carboxyl group in the molecule, having a mass average molecular weight in a range of 20,000 to 1,000,000, and being a solid in room temperature shown in the blend of the luster control layer is obtained , for example, by copolymerizing a (meth)acrylic acid ester monomer having a carboxylic group of (meth)acrylic acid, a (meth) acrylic acid ester monomer having a hydroxyl group of 2-hydroxylethyl (meth)acrylate or 4-hydroxylbutyl (meth) acrylate, a monomer having at least one functional group of the (meth)acrylic acid ester monomers such as 2-aminoethyl (meth)acrylate or 3-aminopropyl(meth)acrylate, and other (meth)acrylic acid esters, styrene derivatives or maleic acid monomers in the presence of a reaction initiator (peroxide or chain reaction transfer agent).

The acrylic resin (f) having a plurality of reactive double bonds in the molecule, having amass average molecular weight in a range of 20,000 to 1,000,000, and being a solid at room temperature, and (g) the acrylic resin having at least one functional group selected from a group comprising hydroxyl group, amino group and carboxyl group and a plurality of reactive double bonds, having a mass average molecular weight in a range of 20,000 to 1,000,000, and being a solid at room temperature shown in the blend of the luster control layer is obtained, for example, by adding monomers having functional groups to an acrylic copolymer having functional groups, which is obtained by copolymerization of a (meth)acrylic acid having a carboxyl group such as (meth)acrylic acid; a (meth)acrylic acid ester monomer having a hydroxyl group such as 2-hydroxylethyl (meth) acrylate and 4-hydroxybutyl (meth)acrylate: a (meth)acrylic acid ester monomer having an amino group such as 2-aminoethyl (meth)acrylate or 3-aminopropyl (meth)acrylate; a (meth)acrylic acid ester monomer having an aziridinyl group such as 2-(1-aziridinyl)ethyl (meth)acrylate or 2-(2-aziridinyl)butyl (meth)acrylate; a monomer having at least one functional group of the (meth)acrylic acid esters having an epoxy group such as glycidyl (meth)acrylate; and other (meth)acrylic acid monomers, styrene derivative monomers and maleic acid derivative monomers in the presence of a reaction initiator (peroxide and chain reaction transfer agent).

The weight average molecular weight (Mw) of these acrylic resins (a), (d), (f) and (g) can be changed by the conditions for polymerization using the reaction initiator. The acrylic resin having the mass average molecular weight in a range of 20,000 to 1,000,000 is preferably used in the invention. The laminated film cannot be sufficiently drawn required for bonding when the mass average molecular weight is less than 20,000, and cracks may be generated. In contrast to the above, when the mass average molecular weight is larger than 1,000,000, the resin is so hardly dissolved in solvents that the it is difficult to form the luster control layer from the photo-curable resin composition. For example, when the luster control layer is formed by casting from a solution, the resin can only be cast at a low concentration, and it is difficult for the luster control layer to have an enough thickness.

The acrylic resin preferably has a glass transition temperature (Tg) in a range of −20 to 100° C. considering the relation between the hardness of the luster control layer after curing and scratch resistance. However, when a not so high surface hardness, for example a hardness represented by a pencil hardness of B or less (at 23° C.), is required, or when almost no stretching of the luster control layer is required, the acrylic resin having Tg out of this range may be used. Any combination of the acrylic resins is possible so long as the molecular weight settles within the range described above. Since the acrylic resins (d) and (g) have functional groups such as the hydroxyl group and amino group, the resin is cross-linked by a cross-linking agent, which improves flexibility of the sheet.

The sum of functional group values (the sum of the OH, $NH_2$ and COOH group values) of the acrylic resins (d) and (g) is preferably in a range of 2 to 50. The $NH_2$ group value is calculated by the same method as calculating the OH group value from the amount of the $NH_2$ group added for polymerization, or by converting the NH2 group into the OH group by allowing the $NH_2$ group te react with nitrous acid. The COOH group value is calculated by the same method as calculating the OH group value from the amount of the COOH group added for polymerization, or by titration of the COOH group with KOH. Improvement of flexibility of the luster control layer cannot be expected in some cases when the functional group value is less than 2. In contrast to the above, the luster control layer cannot be sufficiently stretched when the functional value exceeds 50. However, the acrylic resin out of the range of these functional group values may be used when the luster control layer does not require to be so largely stretched, or when the luster control layer is sufficiently flexible.

These acrylic resin material may be used as a block copolymer at the reactive part thereof, or may be used as a comb-shaped block copolymer. The materials for forming the block copolymer with the reactive acrylic resin material includes acrylic compounds as well as styrene, maleic acid and imide materials that have good compatibility with the acrylic resin. Other materials such as silicon and flourine materials that are able to form block copolymers may be combined. The mass average molecular weight of these materials is adjusted within the range described above, or these materials are blended with the reactive acrylic resin.

Examples of the low molecular weight compound (b) having double bonds in the molecule shown in the blend of the luster control layer include monofunctional (meth)acrylates such as methyl (meth)acrylate, ethyl (meth)acrylate, benzyl (meth)acrylate, 2-ethoxyethyl (meth)acrylate, and phenoxydiethyleneglycol (meth)acrylate; and polyfunctional (meth)acrylates such as 1,6-hexanediol di(meth)acrylate, neopentylglycol di(meth)acrylate, polyethyleneglycol di(meth)acrylate, polypropyleneglycol di(meth)acrylate, trimethylpropane tri(meth)acrylate, pentaerythritol tri(meth) acrylate, pentaerythritol tetra(meth)acrylate, and dipentaerythritol hexa(meth)acrylate.

The low molecular weight compound (b) may be oligomers of polyester acrylate, polyurethane acrylate, polyepoxy acrylate, polyether acrylate, oligo acrylate, polyalkid acrylate and polyol acrylate. These low molecular weight compounds may further contain functional groups such as hydroxyl, amino and carboxylic groups.

The isocyanate cross-linking agent (e) is isocyanate compounds having at least two isocyanate groups in the molecule, and examples of them include monomers of tolylene diisocyanate, diphenylmethane diisocyanate, naphthalene diisocyanate, tolidine diisocyanate, triphenylmethane triisocyanate, tris(isocyanatoohenyl)thiophosphite, p-phenylene diisocyanate, xylylene diisocyanate, bis(isocyanatomethyl) cyclohexane, dicyclohexylmethane diisocyanate, hexamethylene diisocyanate, lysin diisocyanate, hexamethylene diisocyanate and isophorone diisocyanate; trimethylolpropane adduct of these monomers; denatured isocyanurate; denatured biuret; denatured carbodiimide, denatured urethane; and denatured allophanate.

The melamine cross-linking agent (e) include melamine as well as trimethylol melamine obtained by allowing materials having polyfunctional amino groups such as urea, thiourea, guanidine, guanamine, actoguanamine, banzoguanamine, dicyanediamide and guanamine to react with formaldehyde; and ether denatured melamine resin obtained by allowing hexamethylol melaminedimethylol urea, dimethylol guanidine, dimethylol acetoguanamine or dimethylol benzoguanamine to react with alcohols such as butyl alcohol and propyl alcohol.

The epoxy cross-linking agent (e) is a glycidyl compound of a polyfunctional alcohol containing plural epoxy groups, and is used together with a Lewis acid catalyst. The Lewis acid is preferably formulated into microcapsules in order to slow the reaction. Examples of the epoxy cross-linking compound include butadiene dioxide and hexadiene dioxide; glycidyl compounds such as diglycidyl ester of phthalic acid, diglycidyl ester of bisphenol A, diglycidyl ester of bisphenol F, triglycidyletheramine of para-aminophenol, diglycidyl ether of aniline, tetraglycidyl ether of phenylenediamine, diglycidyl ether of sulfoneamide, and triglycidyl ether of glycerin, polyether denatured diglycidyl, polyester denatured diglycidyl, and urethane denatured diglycidyl compound (polymer); and vinylcuclohexene dioxide and dicyclopentadiene dioxide.

These cross-linking agents are preferably added so that the proportion of the functional group value of the acrylic resin to the functional group value of the cross-linking agent is 1:0.7 to 1.3. However, since the functional group's own functional groups or the acrylic resin's own functional groups actually react with each other, for example the melamine cross-linking agents are cross-linked by themselves or the melamine cross-linking agent are cross-linked with the epoxy cross-linking agent, depending on the reactivity of the cross-linking agent with the acrylic resin, the amount of addition is preferably determined by preliminary experiments.

While the filler constituting the luster control layer is not particularly restricted, examples of them include when the filler comprises organic resin particles, homopolymers or copolymers obtained by polymerizing at least one monomer comprising styrene monomers such as styrene, vinylstyrene and chlorostyrene; monoolefin monomers such as ethylene, propylene, butylene and isobutylene; vinyl ester monomers such as vinyl acetate, vinyl propionate, vinyl benzoate and vinyl butylate; α-unsaturated aliphatic monocarboxylic acid ester monomers such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinylether monomers such as vinlymethyl ether, vinylethyl ether and vinylbutyl ether: vinylketone monomers such as vinylmethyl ketone, vinylhexyl ketone and vinylisopropenyl ketone: and diene monomers such as isoprene and 2-chlorobutadiene.

Styrene monomers and α-unsaturated aliphatic carboxylic acid monomers are preferable among them. The resin may be used as a filler constituting the luster control layer by coating the resin with a solvent that does not dissolve the resin when the thermal-fusible resin is used as the filler. However, fine particles of the thermal-fusible resin having a cross-linked structure by adding the cross-linking agent to the thermal-fusible resin, the beat-curable resin, photocurable resin and electron beam curable resin are preferably used.

When the filler constituting the luster control layer comprises inorganic fine particles, examples of them include mica, talc, silica, calcium carbonate, zinc oxide, hallocite clay, kaolin, basic magnesium carbonate, quartz powder, titanium dioxide, barium sulfate, calcium sulfate and alumina.

While the filler is usually spherical, it may be plate, needle or amorphous. While the diffraction index difference between the filler and resin is preferably 0.01 or more for controlling the surface luster, the difference is more preferably 0.1 or more.

While the volume average particle diameter of the filler is preferably 10 μm or less, it is particularly in a range of 0.01 to 5 μm considering the thickness of the luster control layer.

The mass ratio (filler:binder) between the filler and binder in the luster control layer is preferably in a range of 0.3:1 to 3:1, and more preferably in a range of 0.5:1 to 2:1. The luster is not substantially changed before and after forming the image when the proportion of the filler is within the range above. However, light scattering decreases when the proportion is smaller than the range above while the luster control layer can be hardly formed when the proportion is larger than the range above.

While the luster control layer as the function control means 20 has been described above, the function control means 20 is also provided considering light stability, antibacterial property, fire retardancy, releasing ability and charge controlling property. Since the function control means is provided at the opposed surface to the image forming surface with interposition of the substrate 10 as described previously, the surface having the function control means 20 comes to the outside when the film is finally laminated. Accordingly, the layer should have a releasing ability in addition to light stability so that water adhered on the surface of the film is able to be immediately wiped away during use. Otherwise, the surface should have an ability to control an electrostatic property by making the surface resistance to $1.0\times10^{13}$ Ω/□ in order to avoid dusts from adhering on the surface of the film. The film desirably has an antibacterial property considering that the image display is inspected by holding with a hand, or is displayed on the wall in hospital. The film also required to be flame retarding in order to suppress toxic gases from generating to be as small as possible by suppressing combustion caused by heat of fire.

The light stability, releasing ability and electrostatic property may be controlled by appropriately using the substrate used in the invention and the materials and methods described in the luster control layer.

At least one layer of the coating layer may be provided as the image receiving layer on the surface of the substrate 10 so that good images are formed in the electrophotographic laminated film of the invention. While the same resin as the resin constituting the luster control layer may be used for the image receiving layer, a thermal-fusible polyester resin is preferably used in the invention.

The polyester can be usually produced by a reaction between a polyfunctional hydroxyl compound and polybasic carboxylic acid or a reactive acid derivative thereof. While examples of the polyfunctional hydroxyl group include diols such as ethyleneglycol, diethyleneglycol, triethyleneglycol, 1,2-propyleneglycol, 1,3-propyleneglycol, 1,4-butanediol and neopentyl glycol, ethyleneglycol and neopentyl glycol are preferable for the polyester used in the invention.

While examples of the polybasic carboxylic acid include malonic acid, succinic acid, adipic acid, sebacic acid, alkylsuccinic acid, maleic acid, fumaric acid, mesaconic acid, citraconic acid, itaconic acid, glutaconic acid, cyclohexane dicarboxylic acid, isophthalic acid. terephthalic acid and other divalent carboxylic acid, isophthalic acid and terephthalic acid are preferably used from the convenience of production, availability of the material and cost. Since phthalic acid usually comprises isomers of isophthalic acid and terephthalic acid, both compounds are inevitably mixed in approximately 1:1 proportion in the production of the polyester.

In the particularly preferable blend of the invention, the proportion of ethyleneglycol to neopentyl alcohol (ethyleneglycol:neopentyl alcohol) is desirably in a range of 3:7 to 1:9 in molar ratio.

The number average molecular weight of the polyester is preferably in a range of 12,000 to 45,000, more preferably 20,000 to 30,000. When the number average molecular weight is less than 12,000, the resin may exhibit a viscosity at room temperature due to too low softening point even when the molar ratio of ethylene glycol to neopentyl alcohol is within the desired range. When the number average molecular weight exceeds 45,000, in contrast to the above, the softening temperature becomes too high that fixing of the image (toner) becomes poor.

For preventing the film from adhering to and winding on the fixing member in the fixing process of the image, the coating layer desirably contains a natural wax or synthetic wax that is a material having low adhesive property to the fixing member, and a releasing resin or a releasing material such as a reactive silicone compound or denatured silicone oil.

Examples of the releasing material include natural waxes such as carnaubau wax, bee wax, montan wax, paraffin wax and microcrystalline wax, and synthetic waxes such as low molecular weight polyethylene wax, low molecular weight oxidized polyethylene wax, low molecular weight polypropylene wax, low molecular weight oxidized polypropylene wax, higher fatty acid wax and sazole wax. Use of these waxes is not restricted to be only one kind, and a plurality of them may be used in combination.

The releasing resins include silicone resins and fluorine resins, and various denatured silicone resins denatured with polyester, urethane, acrylate, polyimide, olefin, ether, alcohol, fluorine, amino, mercapto and carboxyl groups, heat-curable resins and photo-curable resins may be added.

Since the denatured silicone resin has high affinity with the toner resin as the image forming material and resin particles comprising the thermal-fusible resin of the invention, coloring of the pigment contained in the toner becomes excellent, and the fixing member is prevented from adhering on the electrophotographic laminated film during thermal-fusing due to the releasing ability of the silicone resin.

A reactive silane compound may be mixed with the denatured silicone oil in the invention for attaining lower adhesive property. The reactive silane compound reacts with the resin of the coating layer as well as with the denatured silicone oil, and the reaction product serves as the release agent better than the silicone oil itself as a liquid lubricant. Moreover, it was found that the reaction product is tightly fixed in the coating layer as a release agent after the hardening reaction, and this release agent is not eliminated by mechanical wear and solvent extraction.

The wax and releasing resin may be present as particles like the resin particles comprising the thermal-fusible resin. However, the wax and releasing resin are preferably added in the thermal-fusible resin, and are preferably used by being incorporated into the thermal-fusible resin as a dispersion or solid solution.

The surface resistance of the coating layer should be in a range of $1.0\times10^{8}$ to $1.0\times10^{13}$ Ω/□ as described previously. A conductive polymer, surfactant and conductive metal oxide particles may be added in the coating layer for controlling the surface resistance within the range above. A mat agent is preferably added for improving transfer ability.

Examples of the conductive metal oxide particles include particles of ZnO, TiO, $TiO_2$, $SnO_2$, $Al_2O_3$, $In_2O_3$, SiO, $SiO_2$, MgO, BaO and $MoO_3$. These particles may be used alone, or as a combination of a plurality of them. The metal oxide preferably contains different kinds of elements and, preferably, Al and In are doped in ZnO, Mb and Ta are doped in TiO, and SB, Nb and halogens are doped in $SnO_2$. $SnO_2$ doped with Sb is preferable among them due to small changes of conductivity with time and high stability.

Examples of the lubricating resin used for the mat agent include polyolefin such as polyethylene; and fluorinated resin such as polyvinyl fluoride, polyvinylidene fluoride and polyethylene tetrafluoride (Teflon). They include low molecular weight polyolefin waxes (for example polyethylene wax with a molecular weight of 1,000 to 5,000), high density polyethylene waxes, and paraffin or microcrystalline waxes.

An example of the fluorinated resin is a dispersion of polyethylene tetrafluoride (PTFE).

The resin mat agent has a volume average particle diameter preferably in a range of 0.1 to 10 μm, more preferably in a range of 1 to 5 μm. While the larger the volume average particle diameter is preferable, the mat agent is peeled from the coating layer, or a so-called powder fall phenomenon occurs, when the diameter is too large with an increase of cloudiness (haze).

The content of the mat agent is preferably in a range of 0.1 to 10% by weight, more preferably in a range of 0.5 to 5% by weight, relative to the amount of the coating layer forming resin.

The shape of the mat agent is preferably flat. A previously flattened mat agent may be used, or the mat agent may be flattened In the process for coating and drying by heating the color material receiving layer using a mat agent having a relatively low softening temperature. However, the mat agent is preferably protruded out of the surface of the coating layer.

Inorganic fine particles (for example $SiO_2$, $Al_2O_3$, talk or kaolin) and beads of a plastic powder (for example cross-linked PMMA, polycarbonate, polyethylene terephthalate, polystyrene) may be used together in addition to the materials as described above.

While friction of the film surface should be reduced with the mat agent in order to improve transfer ability of the laminated film, the static friction coefficient of the surface of the film is preferably 2 or less, more preferably 1 or less, for the convenience of use of the film. The kinetic friction coefficient is preferably in a range of 0.2 to 1, more preferably in a range of 0.3 to 0.65.

It is desirable in the electrophotographic laminated surface desirably contains an antibacterial substance depending on the object of the outermost coating layer. The material to be added is selected so as to be stably dispersed in the composition and not to be deteriorated by irradiating a light.

Examples of organic materials for this purpose include thiocyanato compounds, chloropropargyl derivatives, isothiazolinone derivatives, trihalomethylthio compounds, quaternary ammonium salts, biguanide compounds, aldehydes, phenols, benzimidazole derivatives, pyridine oxide, carbanilide and diphenyl ether.

Examples of inorganic materials include zeolite, silica gel, glass, calcium phosphate, zirconium phosphate, silicic acid salts, titanium oxide and zinc oxide.

The inorganic antibacterial agent has s volume average particle diameter of preferably in a range of 0.1 to 10 μm, more preferably in a range of 0.3 to 5 μm. It is basically preferable that the antibacterial agent is exposed on the surface. Accordingly, the volume average particle diameter is selected depending on the thickness of the coating layer. The antibacterial agent is peeled off from the coating layer to arise the powder fall phenomenon when the particle diameter is too large, thereby making the film surface to be readily damaged or increasing cloudiness (Haze).

The content of the antibacterial agent is preferably in a range of 0.05 to 5% by weight, more preferably in a range of 0.1 to 3% by weight, relative to the amount of the coating layer forming resin.

While the light stability material, antibacterial material, flame retarding material, releasing material, charge control agent and mat agent to be added in the coating layer as the image receiving layer have been described, these additives may be added in the luster control layer comprising the resin and filler in order to permit the additives to manifest the same effect. However, the mat agent is added in the luster control layer preferably in a range of 0.1 to 10% by weight, more preferably in a range of 0.5 to 5% by weight, considering the relation with the filler. The volume average particle diameter of the mat agent added in the luster control layer is preferably in a range of 0.1 to 10 μm, more preferably in a range of 1 to 5 μm.

Various additives of plastics such as the heat stabilizer, antioxidant, light stabilizer, lubricant, pigment, plasticizer, cross-linking agent, shock resistance improving agent, antibacterial agent, flame retardant, frame retardant aid, and antistatic agent may be added in the image receiving layer (coating layer).

The image receiving layer and function control layer as the function control means 20 at least comprising the resin and filler are formed on the surface of the substrate 10 by the following method.

Each layer can be formed by the steps comprising mixing at least the resin and filler using an organic solvent or water, preparing a coating liquid by uniformly dispersing the mixture using ultrasonic wave or an apparatus such as a wave rotor, attoliter or sand mill, and directly coating on or allowing the coating liquid to permeate into the surface of the substrate 10.

The coating or permeation methods adopted are conventional methods such as blade coating, wire-bar coating, spray coating, dip coating, beads coating, air knife coating, curtain coating and roll coating.

When both the luster control layer and coating layer are formed together in the coating step, any one of the layers may be formed at first, or both layers may be simultaneously formed.

A good solvent for dissolving the surface of the substrate 10 is preferably used for preparing the coating liquid. Affinity between the substrate 10 and coating layer is enhanced by using such good solvent because, although the film is not sufficiently adhered onto the substrate due to a distinct interface between the coating layer and substrate 10 when a poor solvent is used, no distinct interface is formed by using the good solvent. The surface of the substrate 10 is fused with the coating layer with a sufficiently high bonding force.

However, being a good solvent to the surface of the substrate 10 means that, when the solvent contacts the surface of the substrate 10, the solvent gives some effect on the surface of the substrate 10, and has a solubility more than slightly invading into the surface of the substrate 10 (the surface becomes slightly cloudy).

It is preferable from the view point described above that the surface of the substrate 10 at the side where the coating layer is formed contains the polycarbonate resin and/or the polyallylate resin that has excellent compatibility with the solvent commonly used for the coating liquid. More preferably, the surface is covered with these resins.

While the solvents that causes compatibility between the polycarbonate resin and/or the polyallylate resin and image receiving layer are not particularly restricted so long as they are able to be used for preparing the coating liquid, the same kind of solvents are preferable for the polycarbonate resin and polyallylate resin. Examples of such solvents include aromatic hydrocarbons such as toluene and xylene, halogenated hydrocarbons such as methylene chloride and chlorobenzene, and ketone solvents such as methylethyl ketone and cyclohexanone, as well as tetrahydrofuran and ethyl acetate, and a mixed solvent of these solvent, and a mixed solvent of these solvent and other poor solvents.

While the coating layer formed on the surface of the substrate 10 may be dried in air, drying is more easy using heat-drying. Any conventionally used drying methods such as drying in an oven, drying by passing through the oven, or drying by contacting with a hot roller may be employed. The luster control layer may be formed by the same method as described above.

The thickness of the layer as the function control means formed on the surface of the substrate 10 is preferably in a range of 0.1 to 20 μm, more preferably in a range of 1.0 to 10 μm.

The thickness of the coating layer is also preferably in a range of 0.1 to 20 μm, more preferably in a range of 1.0 to 10 μm.

The method for forming an image by the electrophotographic method on a laminated film P before printing will be described below. The laminated film P comprises the function control layer as the function control means 20 and coating layer as the image receiving layer.

The image is formed on the laminated film P before printing by the electrophotographic method comprising the steps of: uniformly electrifying the surface the surface of an electrophotographic photosensitive material (an image carrier); exposing image information on the surface; forming an electrostatic latent image corresponding to exposure; supplying a toner as an image forming material from a developer onto the electrostatic latent image on the surface f the photosensitive material to convert the electrostatic latent image into a visible image with the toner (forming a toner image); transferring the toner image formed onto a surface of the image receiving layer on the surface of the laminated film P before printing; and finally fixing the toner on the surface of the image receiving layer by applying a heat or pressure to complete an image recording member. The image recording member as used herein refers to as the electrophotographic laminated film of the invention.

Since the laminated surface serves as the image forming surface in the electrophotographic laminated film of the invention, the image formed on the image receiving layer on the surface of the laminated film before printing should be an inverse image (mirror image). Accordingly, image information exposed on the surface of the photosensitive material is preferably provided as mirror image information.

The toner is fixed on the surface of the image receiving layer by simultaneously applying a heat and pressure. However, since the toner makes contact with a fixing member, a part of the toner is transferred to the fixing member when the toner has a low viscosity or has high affinity with the fixing member and is left behind on the fixing member as offset. Consequently, the fixing member is deteriorated to shorten the service life of the fixing device. Therefore, sufficient fixing ability and peeling ability of the toner image are necessary when the electrophotographic laminated film is used as the image recording member.

However, since the surface of the image receiving layer and the surface of the substrate 10 used in the invention have good adhesive property with the toner, the toner is sufficiently fixed on the surface of the laminated film at a temperature below the temperature when the toner is melted and becomes viscous.

Accordingly, the toner image formed on the surface of the electrophotographic laminated film is preferably fixed so that the surface temperature of the electrophotographic laminated film is below the melting point of the toner. The surface temperature of the electrophotographic laminated film is preferably 130° C. or less, more preferably 110° C. or less, considering the melting point of conventional toners.

However, the surface temperature of the substrate 10 may be in a thermal deformation temperature range of the laminated film according to the first aspect of the invention, even when the toner is fixed under the condition described above. As a result, tenacity of the laminated film is weakened, and tends to be wound around the heating roll of the fixing device. It is desirable in such cases to transfer the film by overlaying with a sheet of paper in order to reinforce tenacity of the laminated film in the fixing device, or to reconstruct/adjust the inner structure of the fixing device so that a guide abuts the edge of the film.

In contrast to the above, since non-image parts also contact the fixing member during fixing in the electrophotographic laminated film of the invention, the non-image part is also required to have the same releasing ability as the toner has.

Accordingly, an image receiving layer comprising a thermal-fusible polyester resin is preferably formed on at least one face of the substrate 10. In addition, a luster control layer (function control means 20) comprising the thermal-fusible resin, heat-curable resin, photo-curable resin or electron beam curable resin as well as the filler is preferably formed on the surface of the laminated film opposed to the surface on which the image is formed. The release agent as an additive is preferably added in both layers in order to prevent the film from adhering on the fixing member in the fixing process, while permitting transfer performance in the electrophotographic method to be maintained by adding the antistatic agent.

According to the invention, the function control layer is formed on at least one surface of the laminated film, and a mirror image is formed on the opposed surface with interposition of the substrate 10, thereby enabling a desired electrophotographic laminated film to be obtained.

The electrophotographic laminated film of the invention is excellent in image qualities (color, luster and concealment) that are required in printed matters having high designability, generates no image defects by scratches and foreign substances, and sufficient heat resistance and light stability are ensured even in outdoor uses. The invention provides an electrophotographic laminated film that are free from offset even by using a toner without using an oil, and a method for manufacturing the electrophotographic laminated film. The invention also provides an image forming method using the electrophotographic laminated film.

The function control means 20 is provided on the surface opposed to the image forming surface with interposition of the substrate 10 in the electrophotographic laminated film of the invention. Consequently, luster as well as various functions such as beat resistance, light stability, antibacterial property, fire retardancy, moisture resistance, water repelling property, wear resistant property and scratch resistant property may be given and/or improved. In an example of the electrophotographic laminated film in which the functions are given or improved, a mirror image is formed on the back face of the image recording member (electrophotographic laminated film), and a silicone hard coat layer having luster controlling, light resistant, antibacterial, flame retarding, heat resistant, water repelling and wear resistant properties is formed on the top surface thereof. Accordingly, the film is suitable for printing on the surface of a card such as an ID card, and for a display label. The electrophotographic laminated film having suppressed glossiness by forming the luster control layer on the surface can be favorably used as an ID card film. Thus, functions capable of complying with various modes of uses can be given to the electrophotographic laminated film of the invention.

EXAMPLES

While the present invention is described in more detail with reference to examples, the invention is by no means restricted to these examples. "Parts" in the examples and comparative examples below means "parts by weight".

Example 1

The method by which the electrophotographic laminated film (laminated film 1) of the invention is manufactured is described below with respect to each step.

Preparation of Function Control Layer Coating Liquid A-1

Mixed and thoroughly stirred are 10 parts of polyester resin (trade name: Thermorack P-1, manufactured by Soken Chemical & Engineering Co., Ltd., solid content in methylethyl ketone: 30% by weight) as a thermal-fusible resin, 9 parts of melamine-formaldehyde condensation fine particles (trade name: Epostar S, manufactured by Nippon shokubai Co., mean particle diameter: 0.3 μm) as a filler, 0.2 parts of a quaternary ammonium salt (trade name: Elegan 264 WAX manufactured by Nippon Oil & Fat Co.) as a surfactant, 30 parts of methylethyl ketone, and 5 parts of cyclohexanone, thereby preparing function control layer coating liquid A-1 for controlling surface luster and surface resistance.

Preparation of Image Receiving Layer Coating Liquid B-1

Mixed and thoroughly stirred are 3 parts of polyester resin (trade name: Byron 200 manufactured by Toyobo Co.) as a thermal-fusible resin. 0.05 parts of cross-linked methacrylic acid ester copolymer fine particles (trade name: MP-150 manufactured by soken Chemical & Engineering Co., Ltd., volume average particle diameter: 5 μm) as a mat agent, 0.3 parts of 2-(2-hydroxy-5-methylphenly)-2H-benzotriazole (trade name: Sumisorb 200, manufactured by Sumitomo Chemical Co., Ltd.) as a ultraviolet ray absorber, 0.1 parts of quaternary ammonium salt (trade name: Elegan 264 WAX manufactured by Nippon Oil & Fat Co.) as a surfactant, 40 parts of methylethyl ketone and 5 parts of toluene, thereby preparing image receiving layer coating liquid B-1.

Manufacture and Evaluation of Electrophotographic Laminated Film

The function control layer coating liquid A-1 is coated on one surface of a polycarbonate film (trade name: Upiron S-2000, manufactured by Mitsubishi Engineering-Plastics Corporation, load deflection temperature: 123° C., thickness: 100 μm) using bisphenol A, and a function control layer as a luster controlling layer with a thickness of 1 μm is formed by drying at 90° C. for 1 minute.

Laminated film 1 is produced by forming an image receiving layer (coating layer) with a thickness of 1.5 μm by coating the image receiving layer coating liquid B-1 on the non-coated surface opposed to the coated surface of the substrate, followed by drying at 90° C. for 1 minute.

Each surface resistance of the laminated film 1 is $1.0\times10^{13}$ Ω/□ on the surface of the function control layer, and $1.30\times10^{11}$ Ω/□ on the surface of the image receiving layer.

The laminated film is cut into A4 size (210 mm×297 mm), and a mirror image is printed on the surface of the image receiving layer (opposed surface to the function control layer) for evaluating the following performance.

Evaluation of Performance of Electrophotographic Laminated Film

Color mirror images containing solid images are printed on the surface of the laminated film 1 (before forming images) using a color copy machine (reconstructed machine of trade name: Docu Color 1255CP, manufactured by Fuji Xerox Co., Ltd., reconstructed so that the surface temperature of the laminated film for fixing is 95 to 100° C.), thereby manufacturing the laminated film 1 on which the image is formed.

Running performance in the machine, fixing ability of the image, image density after printing the image of the laminated film 1 are measured. Light stability of the image is evaluated while confirming bonding (adhesive) ability of the card to evaluate the performance of the electrophotographic laminated film.

Evaluation of Running Performance

Running performance of the manufactured laminated film 1 in the color copy machine is evaluated by setting 30 sheets of the laminated film 1 on a manual piper feeding tray of the reconstructed machine of Docu Color 1255CP and by counting the number of incidence of jam (plugging of films) and double transfer when 30 sheets of the laminated film 1 are set and continuously printed. The zero time of incidence is evaluated as "○ (good)", one time of incidence is evaluated as "Δ (passable)", and twice or more of incidence is evaluated as "× (rejectable)".

Evaluation of Fixing Ability

A commercially available adhesive tape with a width of 18 mm (trade name: Cellophane Tape, manufactured by Nichiban Co.) is adhered with a line pressure of 300 g/cm on the solid image with an image density of about 1.8 fixed on the surface of the laminated film 1 using the electrophotographic device described above. Fixing ability of the toner is evaluated using the ratio of the image densities before and after peeling (image density after peeling/image density before peeling: abbreviated as OD ratio) at peeling at a rate of 10 mm/sec. as an index. Toner fixing ability with an OD ratio of 0.8 or more is usually required as an electrophotographic recording medium. The OD ratios of 0.9 ore more, 0.8 or more and less than 0.9, and less than 0.8 are evaluated as "◎", "○" and "×", respectively, in the evaluation of the invention.

Evaluations of Image Density and Image Quality

The image density is measured at the solid image portion using a densitometer (trade name: X-Rite 968, manufactured by X-Rite Co.), and image densities of 1.5 or more, less than 1.5 and 1.3 or more, and less than 1.3 are evaluated as "○", "Δ" and "×", respectively.

The image quality is evaluated by the printing accuracy of letters (reproducibility of printer letters) when the image is outputted under a high temperature high humidity condition (28° C., 80% RH: condition A), room temperature condition (22° C. 50% RH: condition B), and low temperature low humidity condition (15° C., 15% RH: condition C). The image quality is evaluated as good when there is no problem under all the conditions, and is evaluated as "×" with respect to the problematic conditions (such as "A:×" and/or "C:×").

Evaluation of Light Stability

The laminated film 1 is attached in a light stability tester (trade name: SUNTEST CPS+, manufactured by Toyo Seiki Seisakusho Co.) with the surface on which the solid image has been printed downward, and the light stability is measured by irradiating a light at an intensity of 760 W/m$^2$ using a Xe lamp at a temperature of 63° C. for 100 hours The images with image density differences before and after irradiation of less than 0.1, 0.1 or more and 0.5 or less, 0.5 or more and 1.0 or less, and more than 1.0 are evaluated as "◎", "○", "Δ" and "×", respectively.

Lamination Ability

The laminated films 1 are overlaid on the top and back surfaces of A-4 size white sheets (trade name: Diaclail W2012, manufactured by Mitubishi Plastic Co., thickness: 500 μm) having PETG on both surfaces and A-PET as a core, and the sheets are laminated using a laminator (trade name: Lamipacker IPD 3206 City, manufactured by Fujipla Inc.) at 160° C. at a feed speed of 0.3 m/minute (5 mm/sec.).

The lamination ability is evaluated by peeling the white sheet from the laminated film 1 at the interface using a cutter knife, followed by peeling by holding the peeled portion with a hand. The sheet that cannot be peeled is evaluated as "◎", the sheet in which the laminated film is peeled but tore is evaluated as "○", the sheet in which the laminated sheet is peeled, but the image on the peeled surface is distorted and forgery of the card seems difficult is evaluated as "Δ", and the other sheets are evaluated as "×".

The results are summarized in Table 1.

Example 2

Laminated film 2 is produced by the same method as in Examples 1, except that a polycarbonate film (manufactured by Mitsubishi Gas Chemical Company, Inc., lead deflection temperature: 145° C., thickness: 100 μm) using bisphenol Z is used in place of the polycarbonate film using bisphenol A used in Example 1.

The laminated film 2 has a surface resistance of $1.0\times10^{13}$ Ω/□ on the surface of the function control layer and a surface resistance of $1.30\times10^{11}$ Ω/□ on the surface of the image receiving layer, which are the same as those in Example 1. The results are summarized in Table 1.

Example 3

Manufacture and Evaluation of Electrophotographic Laminated Film

Laminated film 3 is produced by the same method as in Examples 1. except that a polycarbonate film (manufactured by Mitsubishi Gas Chemical company, Inc., lead deflection temperature: 150° C., thickness: 100 μm) using bisphenol AP is used in place of the polycarbonate film using bisphenol A used in Example 1.

The laminated film 3 has a surface resistance of $7.5\times10^{11}$ Ω/□ on the surface of the function control layer and a surface resistance of $2.8\times10^{11}$ Ω/□ on the surface of the image receiving layer. The film is cut into A4 size, and is evaluated as in Example 1. The results are summarized in Table 1.

Example 4

Manufacture and Evaluation of Electrophotographic Laminated Film

Laminated film 4 is produced by the same method as in Examples 1, except that a polyallylate film (trade name: U-polymer, manufactured by Unitika Co., lead deflection temperature: 175° C. thickness: 100 μm) using bisphenol A is used in place of the polycarbonate film using bisphenol A used in Example 1.

The laminated film 4 has a surface resistance of $8.5\times10^{11}$ Ω/□ on the surface of the function control layer and a surface resistance of $1.70\times10^{11}$ Ω/□ on the surface of the image receiving layer. The film is cut into A4 size, and is evaluated as in Example 1. The results are summarized in Table 1.

Example 5

Manufacture and Evaluation of Electrophotographic Laminated Film

Laminated film 5 is produced by the same method as in Examples 1, except that a polyallylate/PET/polyallylate three layer film (manufactured by Unitica Co., lead deflection temperature: 175° C., thickness: 100 μm) using bisphenol A is used in place of the polyallylate film using bisphenol A used in Example 1.

The laminated film 5 has a surface resistance of $8.5\times10^{11}$ Ω/□ on the surface of the function control layer and a surface resistance of $1.70\times10^{11}$ Ω/□ on the surface of the image receiving layer. The film is cut into A4 Size, and is evaluated as in Example 1. The results are summarized in Table 1.

Example 6

Manufacture and Evaluation of Electrophotographic Laminated Film

Laminated film 6 is produced by the same method as in Examples 1, except that a polyallylate film (manufactured by Unitica Co., lead deflection temperature: 189° C., thickness: 100 μm) using bisphenol Z is used in place of the polyallylate film using bisphenol A used in Example 4.

The laminated film 6 has a surface resistance of $2.5\times10^{11}$ Ω/□ on the surface of the function control layer and a surface resistance of $3.20\times10^{10}$ Ω/□ on the surface of the image receiving layer. The film is cut into A4 size, and is evaluated as in Example 1. The results are summarized in Table 1.

Example 7

Manufacture and Evaluation of Electrophotographic Laminated Film

Laminated film 7 is produced by the same method as in Examples 1, except that a polyallylate film (manufactured by Unitica Co., lead deflection temperature: 205° C., thickness: 100 μm) using bisphenol AP is used in place of the polyallylate film using bisphenol A used in Example 4.

The laminated film 7 has a surface resistance of $3.4\times10^{11}$ Ω/□ on the surface of the function control layer and a surface resistance of $4.1\times10^{10}$ Ω/□ on the surface of the image receiving layer. The film is cut into A4 size, and is evaluated as in Example 1. The results are summarized in Table 1.

Example 8

Manufacture and Evaluation of Electrophotographic Laminated Film

Laminated film 8 is produced by the same method as in Examples 1, except that a polysultone film (manufactured by Solvey Advanced Polymer Co., lead deflection temperature: 174° C., thickness: 100 μm) is used in place of the polyallylate film using bisphenol A used in Example 1.

The laminated film 4 has a surface resistance of $1.6\times10^{11}$ Ω/□ on the surface of the function control layer and a surface resistance of $2.6\times10^{10}$ Ω/□ on the surface of the image receiving layer. The film is cut into A4 size, and is evaluated as in Example 1. The results are summarized in Table 1.

Example 9

Manufacture and Evaluation of Electrophotographic Laminated Film

Laminated film 9 is produced by the same method as in Examples 1, except that a polyphenylene ether film (trade name: Upiace AH60 manufactured by Mitsubishi Plastic Co., lead deflection temperature: 120° C., thickness: 100 μm) is used in place of the polycarbonate film using bisphenol A used in Example 1.

The laminated film 4 has a surface resistance of $3.9\times10^{11}$ Ω/□ on the surface of the function control layer and a surface resistance of $1.7\times10^{10}$ Ω/□ on the surface of the image receiving layer. The film is cut into A4 size, and is evaluated as in Example 1. The results are summarized in Table 1.

Example 10

Manufacture and Evaluation of Electrophotographic Laminated Film

Laminated film 10 is produced by the same method as in Examples 1, except that a polyphenylene ether film (trade name: Xyron X-9108 manufactured by Asahi Chemical Inductry Co., lead deflection temperature: 150° C., thickness: 100 μm) is used in place of the polycarbonate film using bisphenol A used in Example 1.

The laminated film 4 has a surface resistance of $4.5\times10^{11}$ Ω/□ on the surface of the function control layer and n surface resistance of $1.4\times10^{10}$ Ω/□ on the surface of the image receiving layer. The film is cut into A4 size, and is evaluated as in Example 1. The results are summarized in Table 1.

Example 11

Manufacture and Evaluation of Electrophotographic Laminated Film

Laminated film 11 is produced by the same method as in Examples 1, except that a cycloolefin resin film (trade name: Zeonex 480, manufactured by Nippon Zeon Co., Ltd., lead deflection temperature; 123° C., thickness: 100 μm) is used in place of the polycarbonate film using bisphenol A used in Example 4.

The laminated film 4 has a surface resistance of $3.5\times10^{11}$ Ω/□ on the surface of the function control layer and a surface resistance of $2.9\times10^{10}$ Ω/□ on the surface of the image receiving layer. The film is cut into A4 size, and is evaluated as in Example 1. The results are summarized in Table 1.

Comparative Example 1

Laminated film 12 is produced by the same method as in Example 1, except that a PETO resin film (trade name: Eastar PET7 6763, manufactured by Eastman Chemical Co., load deflection temperature: 64° C.) is used as the substrate material in place of the polycarbonate film used in Example 1.

The laminated film 4 has a surface resistance of $4.7\times10^{11}$ Ω/□ on the surface of the function control layer and a surface resistance of $8.7\times10^{10}$ Ω/□ on the surface of the image receiving layer. The film is cut into A4 size, and is evaluated as in Exampe 1. However, since tenacity is lost during heating, all the samples are wound up on the roll of the fixing device of the color copy machine, failing in obtaining the laminated film on which an image is fixed. Consequently, no evaluation thereafter is impossible. The results are summarized in Table 1.

Comparative Example 2

Laminated film 13 is produced by the same method as in Example 1, except that an ABS resin film (trade name: Stilaxc A3921, manufactured by Asahi Chemical Industry Co., Ltd., load deflection temperature: 109° C.) is used as the substrate material in place of the polycarbonate film used in Example 1.

The laminated film 4 has a surface resistance of $5.7\times10^{10}$ Ω/□ on the surface of the function control layer and a surface resistance of $3.3\times10^{10}$ Ω/□ on the surface of the image receiving layer. The film is cut into A4 size, and is evaluated as in Example 1. Although a laminated film on which an image is fixed is obtained, the image is distorted by lamination since the film is corrugated after passing through the fixing device of the color copy machine due to poor tenacity of the film, arising poor reproducibility. The results are summarized in Table 1.

Comparative Example 3

A dual axis drawn PET film (trade name: Lumilar 100×53, manufactured by Toray Industries, Inc., load deflection temperature: 98° C., thickness: 100 μm) in which an anti-static agent is kneaded is used as a substrate. A laminated film 14 is produced by cutting into A4 size without forming no coating layers on both surfaces of the substrate.

The surface resistance of the laminated film 14 comprising only the substrate is $1.8\times10^{10}$ Ω/□. The laminated film 14 is evaluated as in Example 1. The result show that running performance, fixing ability and light stability are poor, and lamination is impossible due to the low load deflection temperature. The results are summarized in Table 1.

Example 12

Preparation of Function Control Layer Coating Liquid A-2

Added and thoroughly stirred in 30 parts of a mixed solvent of cyclohexane and methylethyl ketone (10/90) are 10 parts of a silicone resin (trade name: SI Coat 801, manufactured by GE Toshiba Silicones Co., Ltd., solid content: 30% by weight) as a heat-curable resin, 0.3 parts of polydimethylsiloxane (trade name: TP145, manufactured by GE Toshiba Silicones Co., Ltd., mean particle diameter 4.5 μm) as a filler, 0.2 parts of a surfactant (trade name: pionin B144V, manufactured by Takemoto Oil & Fat Co., Ltd.), 0.3 parts of 2-(2-hydroxy-5-methylphenyl)-2H-benzotriazole (trade name: Sumisorb 200, manufactured by Sumitomo Chemical Co., Ltd.) as a ultraviolet ray absorber and 0.03 parts of calcium phosphate inorganic antibacterial agent (trade name: Appasider AW, manufactured by Sangi Co.) retaining silver as the antibacterial agent, thereby preparing the function control layer coating liquid A-2 that serves as the release, antibacterial, surface resistance and light stability layers.

Preparation of Image Receiving Layer Coating Liquid B-2

Added and thoroughly stirred in a mixed solvent comprising 10 parts of toluene and 30 parts of methylethyl ketone are 10 parts of a polyester resin (trade name: Folet FF-4 manufactured by Soken Chemical & Engineering Co., Ltd., solid content: 30% by weight), 0.05 parts of cross-linked methacrylic acid ester copolymer fine particles (trade name: MX-1000, manufactured by Soken Chemical & Engineering Co., Ltd., volume average particle diameter: 10 μm) as a mat agent, 0.5 parts of 2-(2-hydroxy-5-methylphenyl)-2H-benzotriazole (trade name: Sumisorb 200, manufactured by Sumitomo Chemical Co., Ltd.) as a ultraviolet ray absorber, 0.1 parts of an antioxidant (trade name: Chelex-500, manufactured by Sakai Chemical Industry Co., Ltd.), 0.2 parts of a surfactant (trade name: Elegan 264WAX, manufactured by Nippon Oil & Fat Co.) and 0.6 parts of perchloropentacyclodecane as a flame retardant, thereby preparing the image receiving layer coating liquid B-2.

Manufacture and Evaluation of Electrophotographic Laminated Film

The function control layer coating liquid A-2 is coated using a wire bar on the surface at one side of a substrate comprising the polycarbonate film (trade name: Upiron S-2000, manufactured by Mitsubishi Engineering-Plastics Corporation, load deflection temperature: 123° C., thickness: 100 μm) using bisphenol A used in Example 1. The film is dried at 90° C. for 1 minute to form a function control layer with a thickness of 2 μm for controlling release ability, antibacterial property, surface resistance and light stability.

The image receiving layer coating liquid B-2 is further coated on the non-coated surface of the substrate opposed to the coating layer above, and the film is dried at 90° C. for 1 minute to form the image receiving layer (coating layer) with a thickness of 1.5 μm, thereby manufacturing the laminated film 15. The laminated film 15 has a surface resistance of $3.8\times10^{12}$ Ω/□ on the function control layer, and a surface resistance of $3.0\times10^{11}$ Ω/□ on the image receiving layer. The film is used by cutting it into A4 size.

The laminated film 15 is evaluated by printing a mirror image on the surface of the image receiving layer (the surface opposed to the function control layer). The results are summarized in Table 1.

The antibacterial property is evaluated by a film adhesion method according to Society of Industrial-Technical for Antibacterial Articles with respect to *Escherichia coli* and *Staphylococcus aureus*. The results are summarized in Table 2. Table 2 shows that the number of viable bacteria cells is quite few after 24 hours, showing that the antibacterial effect has been sufficiently displayed.

For evaluating the fire retardancy, flammability of the film is tested as follows.

A test piece is prepared by cutting the laminated film 15 into a piece with a dimension of 60 mm in width and 150 mm in length. This sample piece is horizontally attached to a U-shaped holder. Then, the test piece of the laminated film 15 is ignited in order to evaluate the fire retardancy of the film. The sample self-extinguishing within 10 seconds is evaluated as "○", and the sample that is not self-extinguishing within 20 seconds is evaluated as "×".

The laminated film 15 is self-extinguishing in about 10 seconds, and is evaluate as "○" from the criterion above.

Example 13

Manufacture and Evaluation of Electrophotographic Laminated Film

The laminated film 16 is produced by the same method as in Example 1, except that a polyallylate film (trade name: U-polymer, manufactured by Unitika Co., load deflection temperature: 175° C., thickness: 100 μm) using bisphenol A is used in place of the polycarbonate film using bisphenol A used in Example 12.

The laminated film 16 has a surface resistance of $5.6\times10^{10}$ Ω/□ on the function control layer, and a surface resistance of $8.40\times10^{10}$ Ω/□ on the image receiving layer. The film is cut it into A4 size, and is evaluated as in Example 12. The results are summarized in Table 1.

The antibacterial property is evaluated by a film adhesion method according to Society of Industrial-Technical for Antibacterial Articles with respect to *Escherichia coli* and *Staphylococcus aureus*. The results are summarized in Table 2. Table 2 shows that the number of viable bacteria cells is quite few after 24 hours, showing that the antibacterial effect has been sufficiently displayed.

Flammability of the laminated film is tested by the same method as in Example 12, and is evaluated as "○" since the film is self-extinguishing in 8 seconds.

Example 14

Preparation of Image Receiving Layer Coating Liquid B-3

Added and thoroughly stirred in a mixed solvent comprising 30 parts of toluene and 90 parts of methylethyl ketone for preparing the image receiving layer coating liquid B-3 are 25 parts of a polyester resin (trade name: Thermorack F-1, manufactured by Soken Chemical & Engineering Co., Ltd., solid content: 30% by weight), 0.1 parts of cross-linked methacrylic acid ester copolymer fine particles (trade name: MX-1000, manufactured by Soken Chemical & Engineering Co., Ltd., volume average particle diameter: 10 μm) as a mat agent, 0.6 parts by weight of a surfactant (trade name: Blegan 264WAX, manufactured by Nippon Oil & Fat Co.), 0.04 parts of a zirconium phosphate inorganic antibacterial agent (trade name: Novalon AG 300, manufactured by Toagosei Co.) retaining Ag.

Manufacture and Evaluation of Electrophotographic Laminated Film

The image receiving layer coating liquid B-3 is coated on both surfaces of the polyallylate film as the substrate used in Example 4 using a wire-bar. The film is dried at 90° C. for 1 minute to manufacture the laminated film 17 by foaming the image receiving layer with a thickness of 2 μm. The surface resistance of the laminated film 17 is $7.3\times10^{9}$ Ω/□, and the film is used by cutting it into A4 size.

The laminated film 17 is evaluated as in Example 1 by printing a mirror image on the image receiving layer at one side of the substrate. The results are summarized in Table 1.

The antibacterial property is evaluated by a film adhesion method according to Society of Industrial-Technical for Antibacterial Articles with respect to *Escherichia coli* and *Staphylococcus aureus*. The results are summarized in Table 2. Table 2 shows that the number of viable bacteria cells is quite few after 24 hours, showing that the antibacterial effect has been sufficiently displayed.

Comparative Example 4

The image receiving layer coating liquid B-3 used in Example 14 is coated on both surfaces of a substrate comprising a PET film (trade name: Lumilar 100T60, manufactured by Toray Industries, Inc., load deflection temperature: 250° C. or more (speculated)) using a wire bar. The laminated film 18 is produced by drying the coated film at 90° C. for 1 minute to form the image receiving layer with a thickness of 2.0 μm.

The laminated film 18 has a surface resistance of $2.2\times10^{9}$ Ω/□. The film is used by cutting it in A4 size.

The laminated film 18 is evaluated by the same method as in Example 1 by printing a mirror image on the surface of the image receiving layer (the surface opposed to the function control layer). However, the adhesive property between the image receiving layer and PET film is insufficient in the peeling test after lamination. Only the PET film is completely peeled off, showing that forgery is easy. The results are summarized in Table 1.

TABLE 1

| | Running performance | Fixing ability | Image density | Image quality | Light stability | Lamination ability |
|---|---|---|---|---|---|---|
| Example 1 | ○ | ◎ | ○ | ○ | ◎ | ◎ |
| Example 2 | ○ | ◎ | ○ | ○ | ◎ | ◎ |
| Example 3 | ○ | ◎ | ○ | ○ | ◎ | ◎ |
| Example 4 | ○ | ◎ | ◎ | ○ | ◎ | ◎ |
| Example 5 | ○ | ◎ | ◎ | ○ | ◎ | ◎ |
| Example 6 | ○ | ◎ | ◎ | ○ | ◎ | ◎ |
| Example 7 | ○ | ◎ | ◎ | ○ | ◎ | ○ |
| Example 8 | ○ | ◎ | ◎ | ○ | ◎ | ○ |
| Example 9 | ○ | ◎ | ○ | ○ | ◎ | ◎ |
| Example 10 | ○ | ◎ | ◎ | ○ | ◎ | ◎ |
| Example 11 | ○ | ◎ | ○ | ○ | ◎ | ◎ |
| Comparative Example 1 | X | — | — | — | — | — |
| Comparative Example 2 | Δ | ○ | ○ | X | ○ | ○ |
| Comparative Example 3 | X | X | ○ | ○ | Δ | X |
| Example 12 | ○ | ◎ | ◎ | ○ | ◎ | ◎ |
| Example 13 | ○ | ◎ | ◎ | ○ | ◎ | ◎ |
| Example 14 | ○ | ◎ | ◎ | ○ | ◎ | ◎ |
| Comparative Example 4 | ○ | ○ | ○ | ○ | ○ | X |

TABLE 2

| | Name of test bacteria | Test piece | Initial number of added cells | Number of viable cells (after 24 hours) |
|---|---|---|---|---|
| Example 12 | *Escherichia coli* | Laminated film 15 | $2.6\times10^{5}$ | <10 |
| | | Blank | | $4.7\times10^{5}$ |
| | | Control | | $4.8\times10^{5}$ |
| | *Staphylococcus aureus* | Laminated film 15 | $4.0\times10^{5}$ | <10 |
| | | Blank | | $9.2\times10^{6}$ |
| | | Control | | $6.8\times10^{5}$ |

TABLE 2-continued

| | Name of test bacteria | Test piece | Initial number of added cells | Number of viable cells (after 24 hours) |
|---|---|---|---|---|
| Example 13 | *Escherichia coli* | Laminated film 16 | $2.5 \times 10^5$ | <10 |
| | | Blank | | $4.5 \times 10^5$ |
| | | Control | | $4.5 \times 10^5$ |
| | *Staphylococcus aureus* | Laminated film 16 | $3.9 \times 10^5$ | <10 |
| | | Blank | | $8.7 \times 10^5$ |
| | | Control | | $9.5 \times 10^5$ |
| Example 14 | *Escherichia coli* | Laminated film 17 | $2.5 \times 10^5$ | <10 |
| | | Blank | | $3.5 \times 10^7$ |
| | | Control | | $3.8 \times 10^7$ |
| | *Staphylococcus aureus* | Laminated film 17 | $3.8 \times 10^5$ | <10 |
| | | Blank | | $9.4 \times 10^5$ |
| | | Control | | $1.1 \times 10^5$ |

Tables 1 and 2 show that each laminated film in Examples 1 to 14 has sufficient fixing ability, a certain degree or more of image density, light stability, lamination ability and antibacterial property as well as fire retardancy as shown in Examples 12 and 13.

The electrophotographic laminated film can be readily manufactured According to the invention. A high quality image having sufficient light stability for outdoor uses can be formed with high recognition of view. The electrophotographic laminated film can comply with various application modes by providing a function control means on the surface opposed to the image forming surface.

What is claimed is:

1. An electrophotographic laminated film comprising at least one coating layer disposed on a surface of a substrate, wherein a surface resistance of an uppermost layer of the coating layer is in a range of $1.0\times10^8$ to $1.0\times10^{13}$ Ω/□, and the surface of the substrate comprises at least one of a polycarbonate resin and a polyallylate resin, wherein the substrate has a load deflection temperature of at least 115° C.

2. An electrophotographic laminated film according to claim 1, wherein the coating layer is an image receiving layer including a resin and a filler.

3. An electrophotographic laminated film according to claim 2, wherein the resin included in the image receiving layer is a polyester resin.

4. An electrophotographic laminated film according to claim 1, wherein the coating layer comprises at least one of an antistatic agent, an antibacterial agent, a ultraviolet ray absorber and an antioxidant.

5. An electrophotographic laminated film according to claim 1, wherein the substrate is transparent.

6. An electrophotographic laminated film according to claim 1, wherein the substrate is formed of a resin including a non-chlorine resin as a principal component.

7. An electrophotographic laminated film according to claim 1, wherein function control means is provided on a side opposed to a side on which an image will be formed, with the substrate interposed therebetween, the function control means controlling at least one function selected from the group consisting of luster, light stability, antibacterial property, fire retardancy, releasing property and electrostatic property.

8. An electrophotographic laminated film according to claim 7, wherein the coating layer is an image receiving layer including a resin and a filler.

9. An electrophotographic laminated film according to claim 8, wherein the resin included in the image receiving layer is a polyester resin.

10. An electrophotographic laminated film comprising at least one coating layer disposed on a surface of a substrate, wherein a surface resistance of an uppermost layer of the coating layer is in a range of $1.0\times10^8$ to $1.0\times10^{13}$ Ω/□, and the substrate has a load deflection temperature of at least 115° C.

11. An electrophotographic laminated film according to claim 10, wherein the coating layer comprises at least one of a charge control agent, an antibacterial agent, a ultraviolet ray absorber and an antioxidant.

12. An electrophotographic laminated film according to claim 10, wherein the substrate is transparent.

13. An electrophotographic laminated film according to claim 10, wherein the substrate is formed of a resin comprising a non-chlorine resin as a principal component.

14. An electrophotographic laminated film according to claim 10, wherein function control means is provided on a side opposed to a side on which an image will be formed, with the substrate interposed therebetween, the function control means controlling at least one function selected from the group consisting of luster, light stability, antibacterial property, fire retardancy, releasing property and electrostatic property.

15. A method for producing an electrophotographic laminated film, comprising the step of forming at least one of the coating layer and the function control means is formed by providing a coating liquid; wherein the electrophotographic laminated film comprises a substrate and at least one of the coating layer and the function control means provided on a surface of the substrate, the uppermost layer of the coating layer has a surface resistance in a range of $1.0\times10^8$ to $1.0\times10^{13}$ Ω/□, the surface of the substrate comprises at least one of a polycarbonate resin and a polyallylate resin, wherein the substrate has a load deflection temperature of at least 115° C., and a solvent contained in the coating liquid permits at least one of the coating layer and function control means to be formed while dissolving the surface of the substrate.

16. A method for forming an image on an electrophotographic laminated film, comprising the step of forming a toner image on a surface of the electrophotographic laminated film as a mirror image; wherein the electrophotographic laminated film comprises a substrate and a coating layer provided on a surface of the substrate, an uppermost layer of the coating layer has a surface resistance in a range of $1.0\times10^{8}$ to $1.0\times10^{13}$ Ω/□, the substrate has a load deflection temperature of at least 115° C.; and the surface of the substrate includes at least one of a polycarbonate resin and a polyallylate resin in the surface thereof.

* * * * *